US009770119B1

(12) United States Patent
Shamie et al.

(10) Patent No.: US 9,770,119 B1
(45) Date of Patent: Sep. 26, 2017

(54) ADJUSTABLE INCLINE SLEEPER

(71) Applicant: Delta Enterprise Corp., New York, NY (US)

(72) Inventors: Sam L. Shamie, New York, NY (US); Scott A. Lewis, New York, NY (US); Francisco J. Reyes, New York, NY (US)

(73) Assignee: Delta Enterprise Corp., New York, NY (US)

( * ) Notice: Subject to any disclaimer, the term of this patent is extended or adjusted under 35 U.S.C. 154(b) by 0 days.

(21) Appl. No.: 15/240,175

(22) Filed: Aug. 18, 2016

(51) Int. Cl.
*A47D 9/02* (2006.01)
*A47D 9/00* (2006.01)

(52) U.S. Cl.
CPC ..... *A47D 9/005* (2013.01); *A47D 9/02* (2013.01)

(58) Field of Classification Search
CPC ..... A47D 9/005; A47D 9/02
USPC ..... 5/101–102, 105–107
See application file for complete search history.

(56) References Cited

U.S. PATENT DOCUMENTS

2013/0318709 A1* 12/2013 Bellows ..... A47D 9/02 5/101

* cited by examiner

*Primary Examiner* — Fredrick Conley
(74) *Attorney, Agent, or Firm* — Richard M. Goldberg

(57) ABSTRACT

An adjustable incline sleeper includes a lower base frame including lower support members movable between a first rocking position which permits rocking of the adjustable incline sleeper in a transverse direction and a second non-rocking position which prevents rocking of the adjustable incline sleeper; an upper support frame; a covering body secured to the upper support frame for supporting an infant thereon; and a pivotable connection arrangement for connecting the upper support frame to the lower base frame in a manner to permit transverse pivotable movement of the upper support frame relative to the lower base frame to change an inclination angle between the upper support frame and the lower support frame.

18 Claims, 31 Drawing Sheets

ADJUSTABLE INCLINE SLEEPER

BACKGROUND OF THE INVENTION

The present invention relates generally to infant sleepers, and more particularly, is directed to an adjustable incline sleeper.

Bassinets are well known substitutes for large cribs, particularly for newborn infants, because of their smaller size. Because of their small size, they are generally well suited for transportation to and storage at different locations.

However, in many cases, bassinets also too large and bulky. Recently, Fisher-Price, Inc. has introduced a sleeper, which is formed by a frame which, when opened, has an X-shape with a fabric seat connected between the spaced apart upper ends for supporting an infant thereon. The upper ends of the frame can be inclined so that the fabric seat is also slightly inclined. The lower end supports are slightly curved so that the sleeper can be rocked back and forth gently, either by hand, or by a motor. This sleeper is advertised as being a sleeper in which an infant can nap or even sleep through the night, as well as being a playtime seat. Because of the X-shaped frame, this sleeper can be pivoted to a closed position in which the X-shape is collapsed and folded flat for storage and transportation.

However, the inclination of the upper end is at a fixed angle at all times. Further, the inclination angle is very small so that the infant cannot effectively sit up in the sleeper. Therefore, to feed the infant, it is necessary to remove the infant from the sleeper and place the infant in a highchair or the like.

SUMMARY OF THE INVENTION

Accordingly, it is an object of the present invention to provide an adjustable incline sleeper that overcomes the aforementioned problems.

It is another object of the present invention to provide an adjustable incline sleeper in which the inclination angle can be adjusted.

It is still another object of the present invention to provide an adjustable incline sleeper which can also rock back and forth.

It is yet another object of the present invention to provide an adjustable incline sleeper which can also be prevented from rocking back and forth.

It is a further object of the present invention to provide an adjustable incline sleeper that folds flat and compact for storage and transportation.

It is a still further object of the present invention to provide an adjustable incline sleeper that is easy and economical to use and manufacture.

In accordance with an aspect of the present invention, an adjustable incline sleeper includes a lower base frame including lower support members movable between a first rocking position which permits rocking of the adjustable incline sleeper in a transverse direction and a second non-rocking position which prevents rocking of the adjustable incline sleeper; an upper support frame; a covering body secured to the upper support frame for supporting an infant thereon; and a pivotable connection arrangement for connecting the upper support frame to the lower base frame in a manner to permit transverse pivotable movement of the upper support frame relative to the lower base frame to change an inclination angle between the upper support frame and the lower support frame.

Specifically, each lower support member includes a curved tube which is movable between a downwardly convex position in the first rocking position and an upwardly convex position in the second non-rocking position. The curved tube further includes at least one stop extension mounted thereto which is moved into supporting contact with a ground surface to prevent rocking of the adjustable incline sleeper when the curved tube is moved to the upwardly convex position in the second non-rocking position. There is also an arrangement for releasably locking the curved tube between the downwardly convex position in the first rocking position and the upwardly convex position in the second non-rocking position.

The pivotable connection arrangement includes a pivot connection which pivotally connects together a first side of the upper support frame to the lower base frame; and an adjustment arrangement for adjusting a vertical separation distance of an opposite second side of the upper support frame to the lower base frame.

The adjustment arrangement includes a housing mounted to the second side of either the upper support frame or the lower base frame; an adjustment rod having one end mounted to the side of the other of the upper support frame or the lower base frame; the adjustment rod slidably received in the housing; and a releasable locking arrangement for releasably locking the adjustment rod at different positions to the housing so as to adjust the distance of the second side of the upper support frame to the lower base frame.

The releasable locking arrangement includes a plurality of spaced apart openings in the adjustment rod, and a pin in the housing which is adapted to selectively enter a selected one of the spaced apart openings. The releasable locking arrangement further includes a slide having the pin secured thereto and which is slidably mounted in a first direction in the housing, the slide including a first wedge surface, a spring member for biasing the slide in a direction for moving the pin into a selected one of the spaced apart openings, and a release member slidably mounted in the housing in a second direction transverse to the first direction, and including a second wedge surface for engaging the first wedge surface to move the slide in a direction against the biasing force of the spring member in order to remove the pin from the selected one of the spaced apart openings.

The lower base frame includes a first U-shaped base tube including one lower support member; a second opposite U-shaped base tube including another lower support member; and a first pivoting connection assembly which pivotally connects together the first and second U-shaped base tubes for movement between an inverted V-shape in an operative condition of the adjustable incline sleeper and a collapsed, closed condition in which the first and second U-shaped base tubes are substantially parallel and adjacent to each other.

The upper support frame includes a third U-shaped support tube having an upper end to which the covering body is secured; a fourth U-shaped support tube having an upper end to which the covering body is secured; and a second pivoting connection assembly which pivotally connects together the third and fourth U-shaped support tubes for movement between a V-shape in an operative condition of the adjustable incline sleeper and a collapsed, closed condition in which the third and fourth U-shaped support tubes are substantially parallel and adjacent each to other.

Specifically, the first pivoting connection assembly includes a lower left side pivot assembly which pivotally connects together a left side of the first and second U-shaped support tubes, and a lower right side pivot assembly which pivotally connects together a right side of the first and second U-shaped support tubes; and the second pivoting connection assembly includes an upper left side pivot assembly which pivotally connects together a left side of the third and fourth U-shaped support tubes, and an upper right side pivot assembly which pivotally connects together a right side of the third and fourth U-shaped support tubes.

The pivotable connection arrangement includes a pivot connection which pivotally connects together the lower right side pivot assembly and the upper right side pivot assembly; and an adjustment arrangement connected between the lower left side pivot assembly and the upper left side pivot assembly for adjusting a vertical separation distance of a left side of the upper support frame to the lower base frame.

The adjustment arrangement includes a housing mounted to either the lower left side pivot assembly or the upper left side pivot assembly; an adjustment rod having one end mounted to the other of the lower left side pivot assembly and the upper left side pivot assembly; the adjustment rod slidably received in the housing; and a releasable locking arrangement for releasably locking the adjustment rod at different positions to the housing so as to adjust the distance of the upper left side pivot assembly to the lower left side pivot assembly.

The releasable locking arrangement includes a plurality of spaced apart openings in the adjustment rod, and a pin in the housing which is adapted to selectively enter a selected one of the spaced apart openings. The releasable locking arrangement further includes a slide having the pin secured thereto and which is slidably mounted in a first direction in the housing, the slide including a first wedge surface, a spring member for biasing the slide in a direction for moving the pin into a selected one of the spaced apart openings, and a release member slidably mounted in the housing in a second direction transverse to the first direction, and including a second wedge surface for engaging the first wedge surface to move the slide in a direction against the biasing force of the spring member in order to remove the pin from the selected one of the spaced apart openings.

The above and other objects, features and advantages of the invention will become readily apparent from the following detailed description thereof which is to be read in connection with the accompanying drawings.

DETAILED DESCRIPTION

Figure 1:
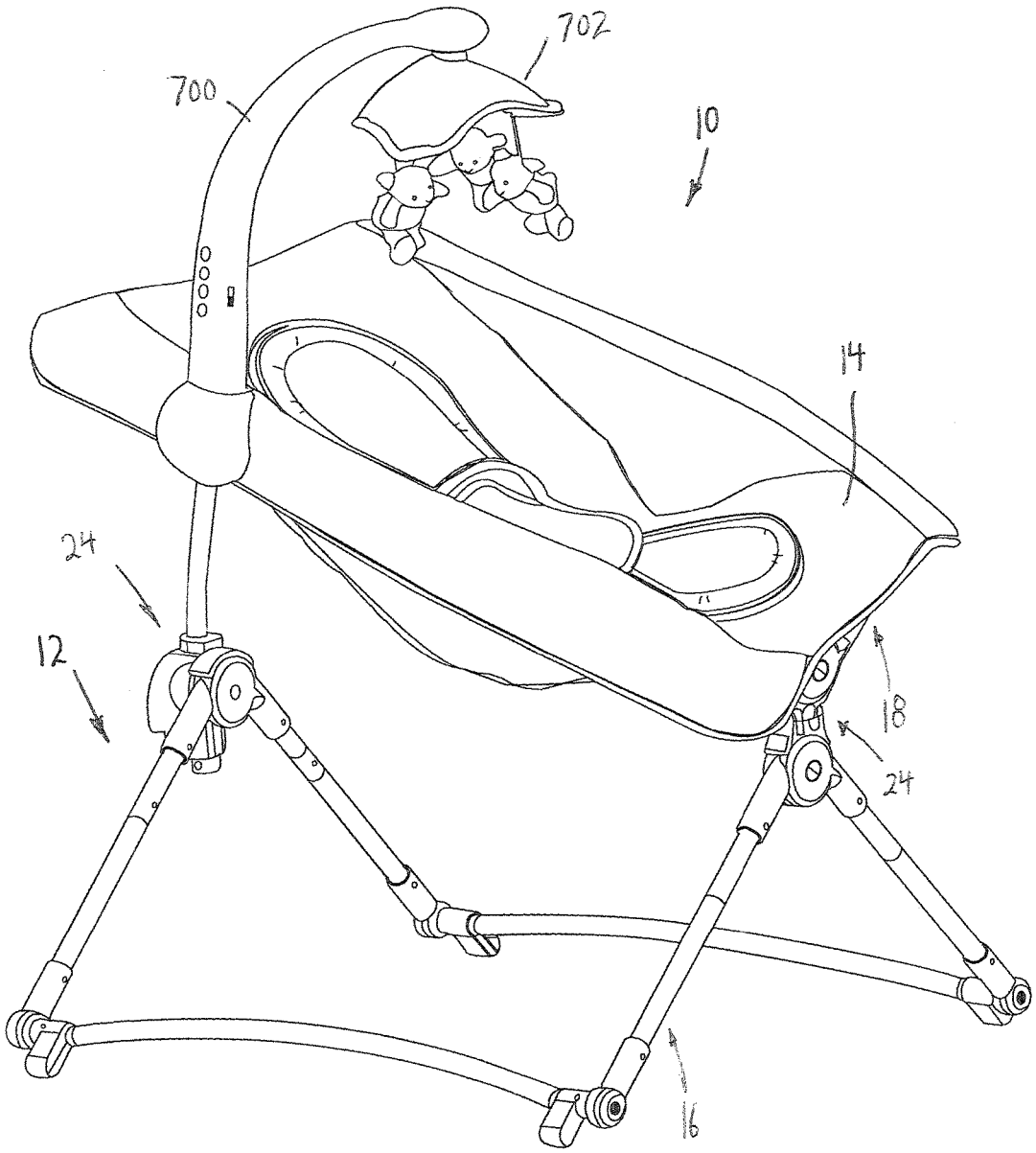
FIG. 1 is a perspective view of an adjustable incline sleeper according to the present invention.

Referring to the drawings in detail, an adjustable incline sleeper 10 according to the present invention includes an X-shaped frame 12 and a flexible covering body 14 therefor.

Frame 12 includes a lower pivotable base frame 16, an upper pivotable support frame 18, and a transverse pivotable connection arrangement 24 for connecting upper support frame 18 to lower base frame 16 in a manner to permit transverse pivotable movement at a left side of frame 12 relative to a right side of frame 12.

Figure 2:
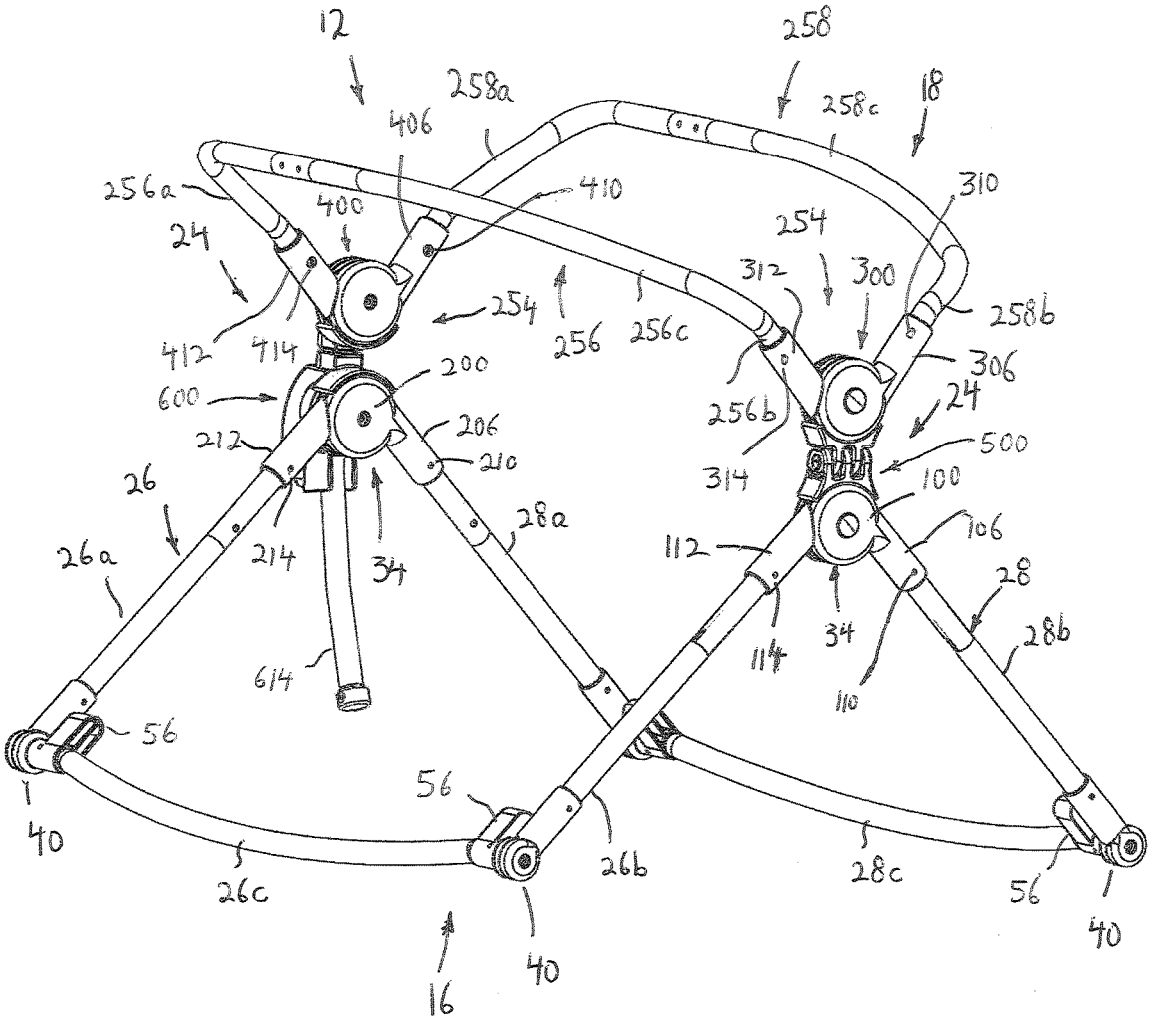
FIG. 2 is a right side perspective view of the frame of the adjustable incline sleeper in a fully opened, rockable configuration and at the lowest inclination angle.
Figure 3:
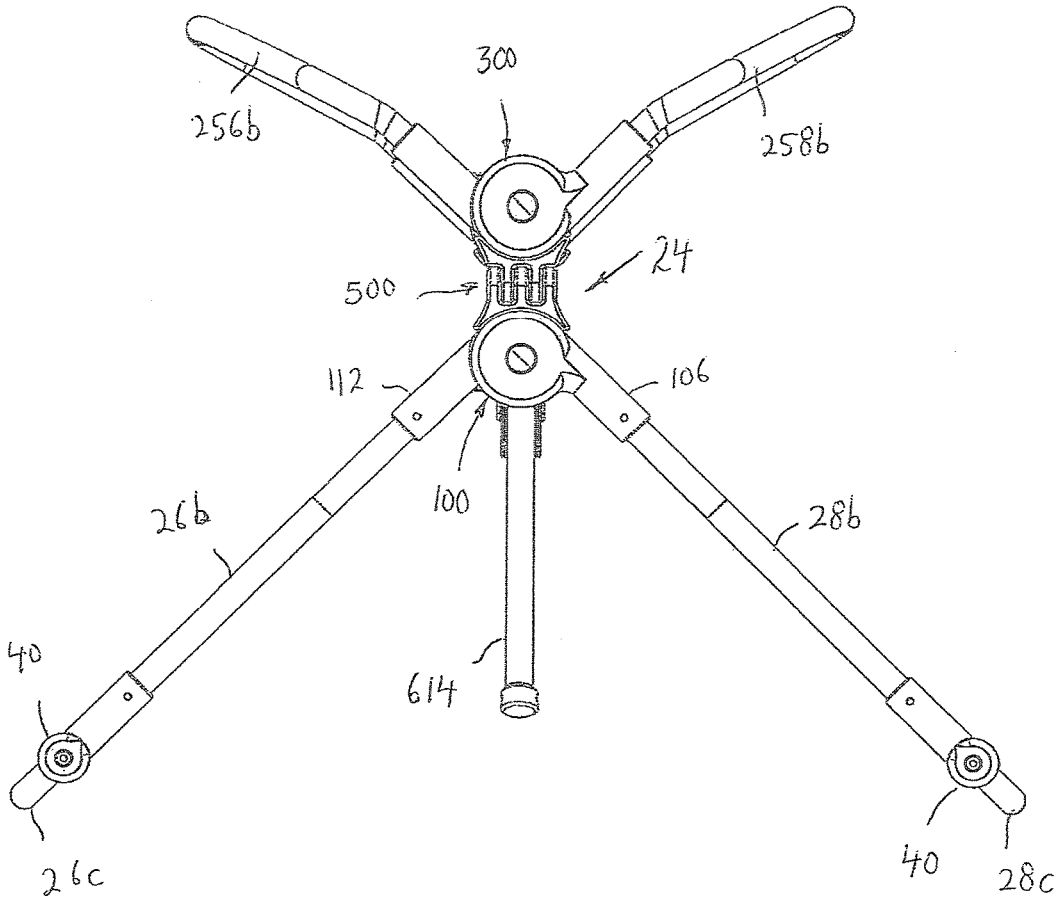
FIG. 3 is a right side elevational view of the adjustable incline sleeper of FIG. 2.
Figure 4:
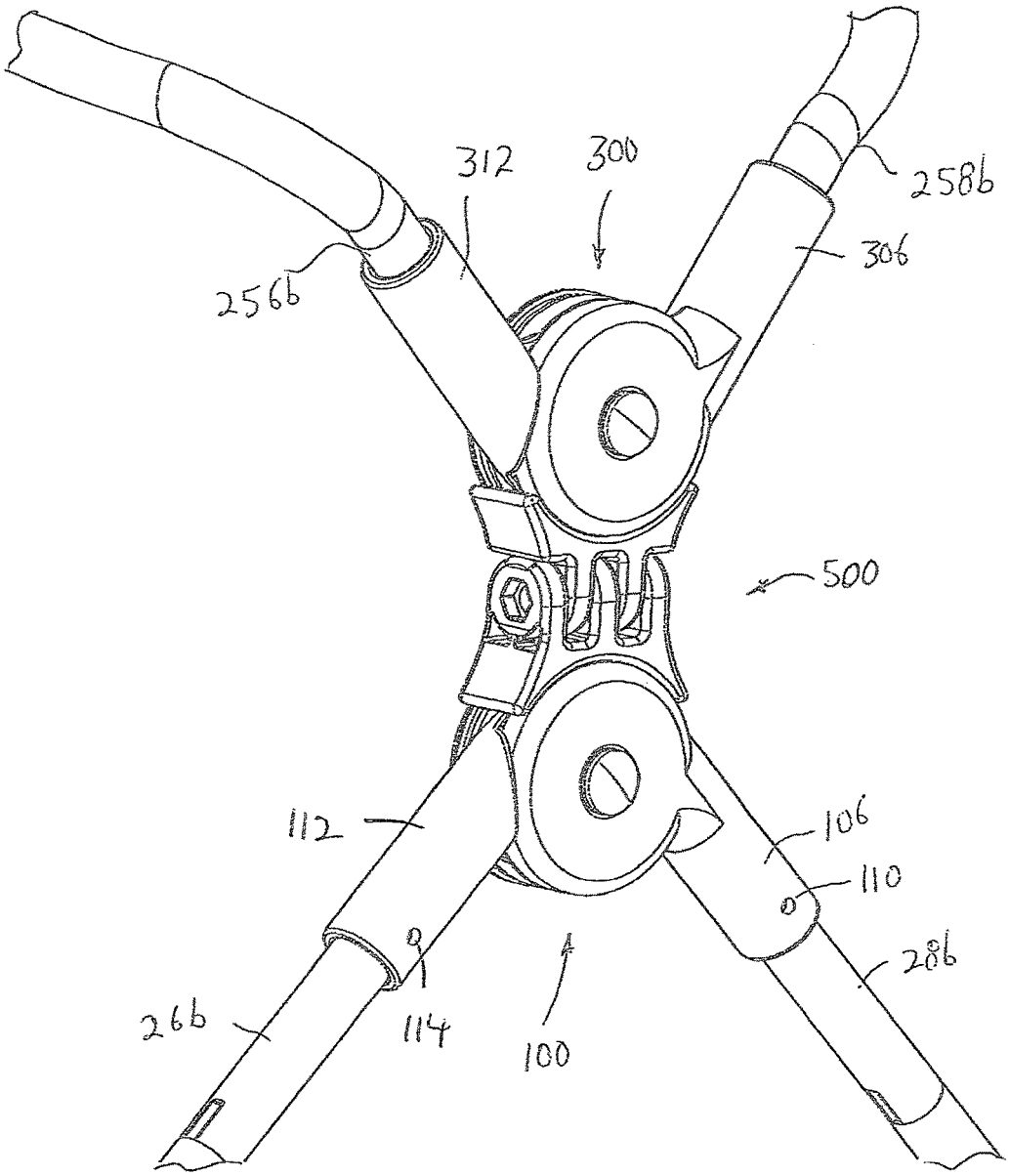
FIG. 4 is an enlarged, perspective view of the pivot assembly at the right side of the frame of FIG. 2.
Figure 5:
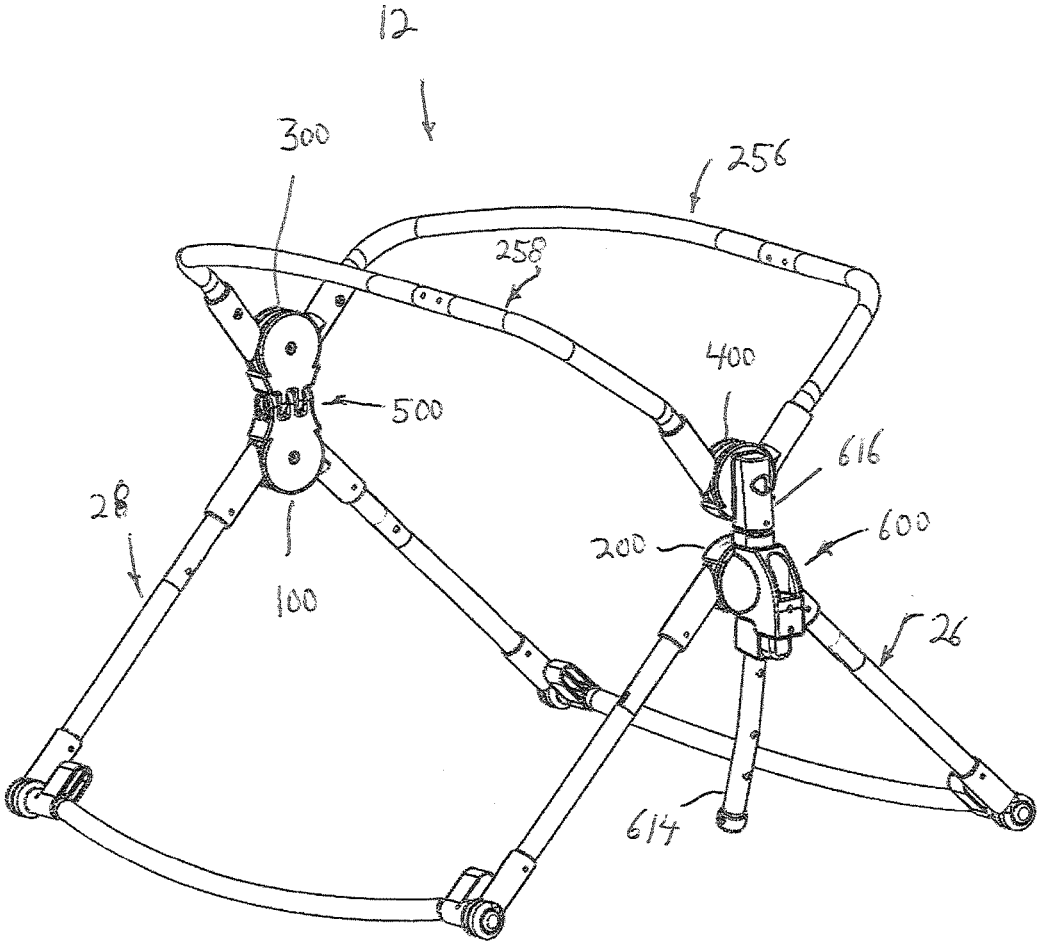
FIG. 5 is a left side perspective view of the adjustable incline sleeper of FIG. 2.
Figure 6:
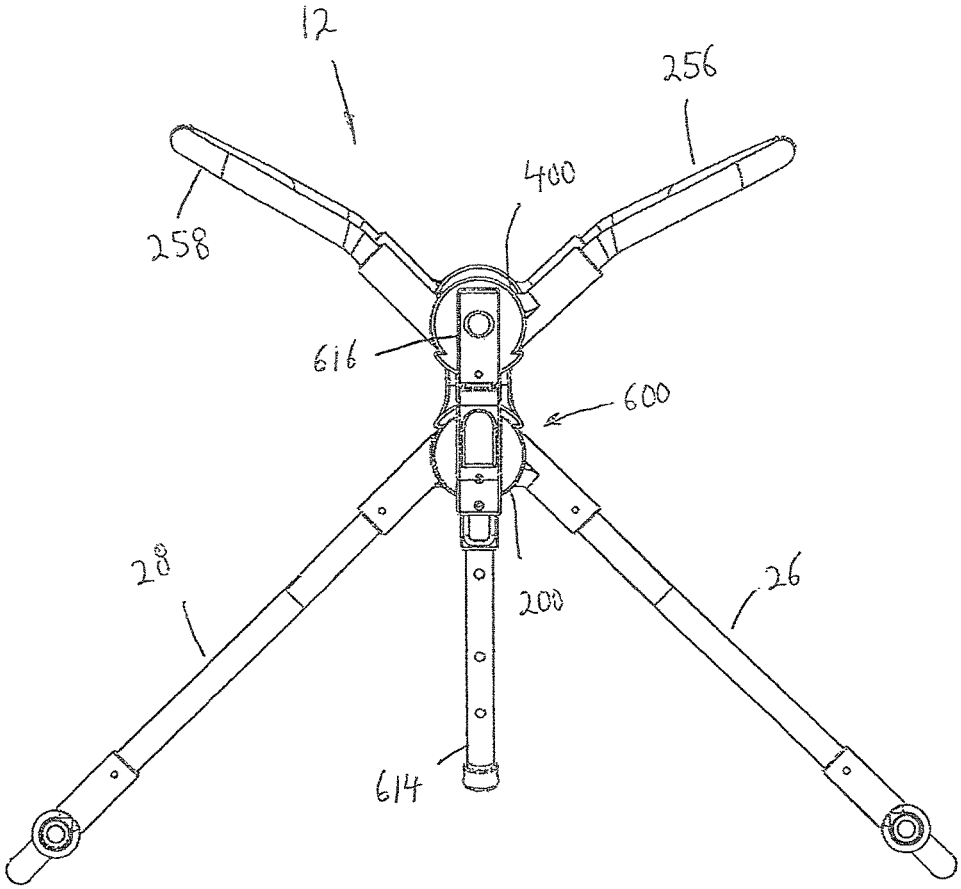
FIG. 6 is a left side elevational view of the adjustable incline sleeper of FIG. 2.
Figure 7:
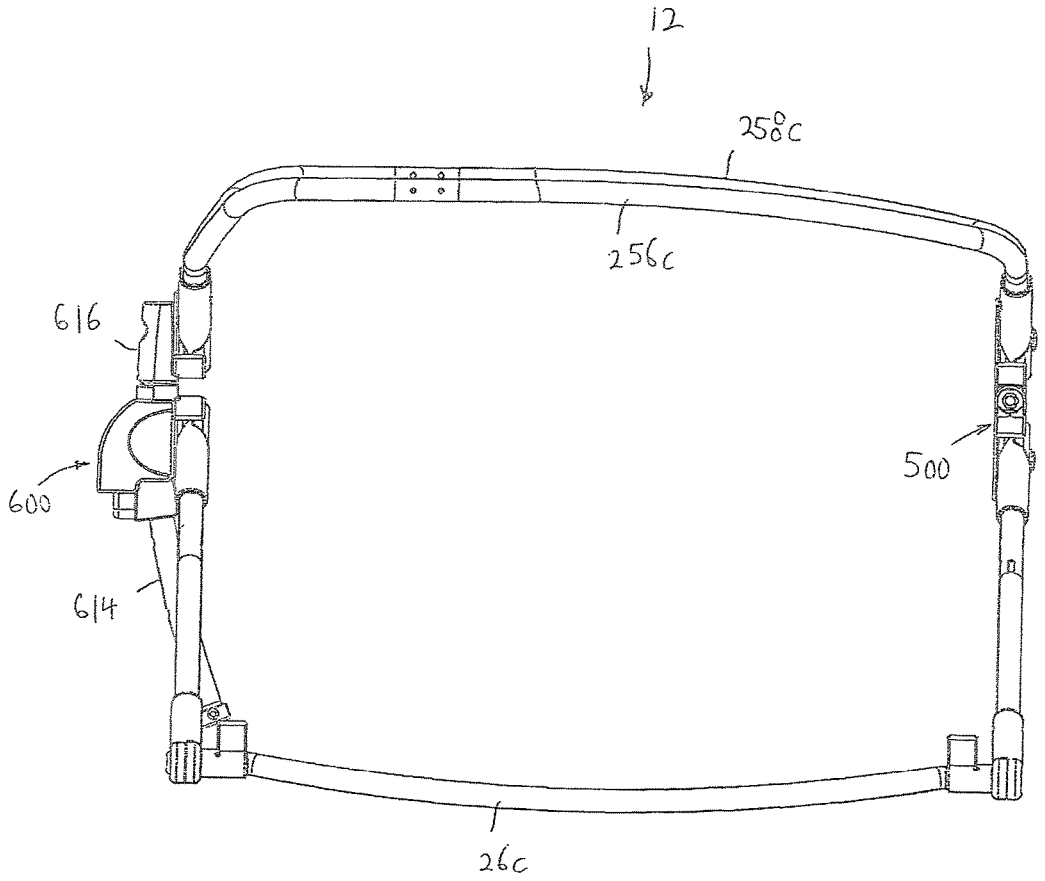
FIG. 7 is a front elevational view of the adjustable incline sleeper of FIG. 2.
Figure 14A:
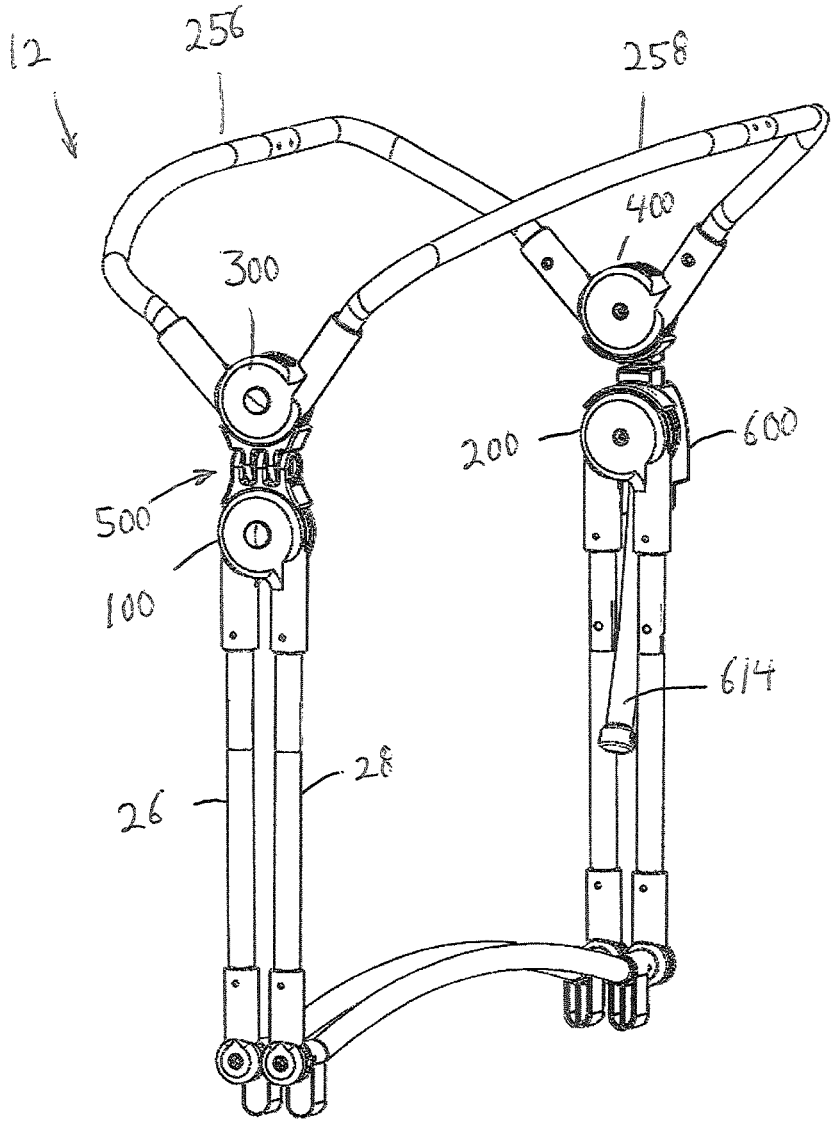
FIG. 14A is a perspective view of the adjustable incline sleeper of FIG. 2 in a partially collapsed, closed state.
Figure 14B:
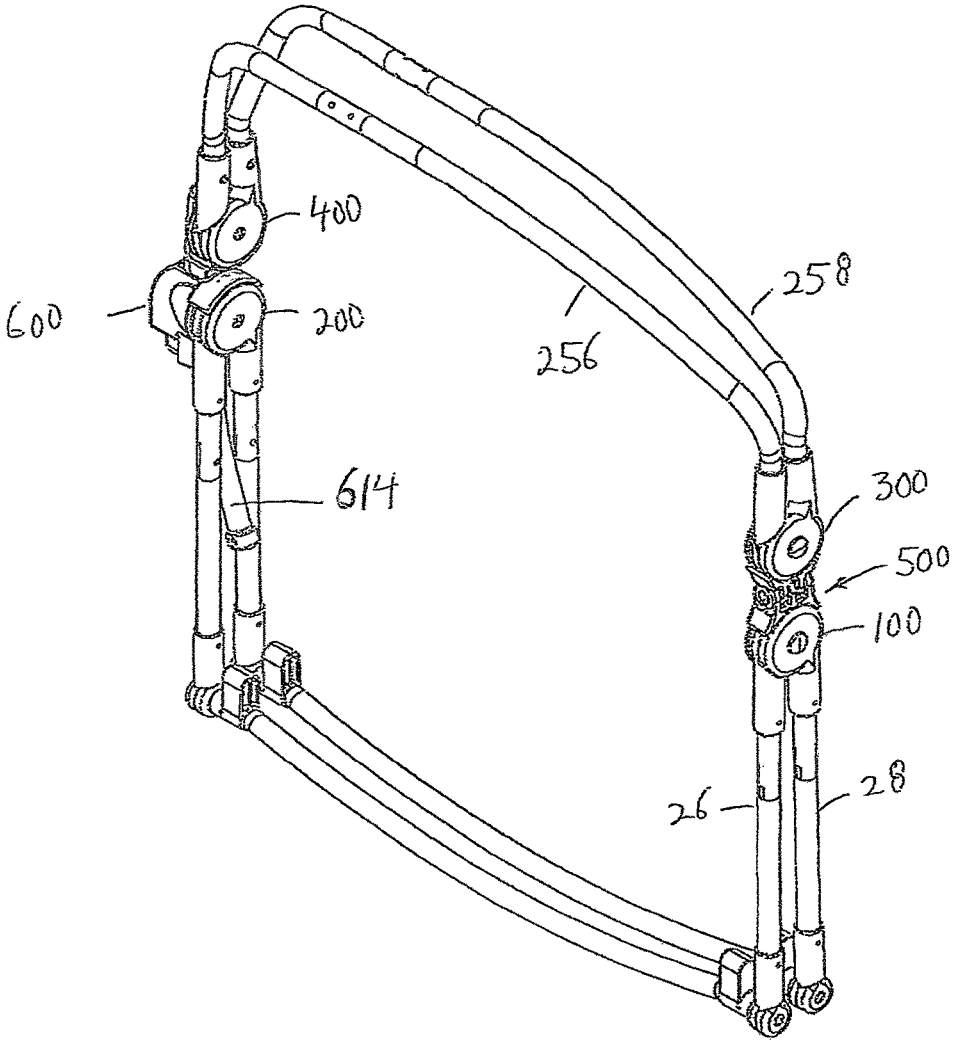
FIG. 14B is a perspective view of the adjustable incline sleeper of FIG. 2 in a fully collapsed, closed state.
Figure 15:
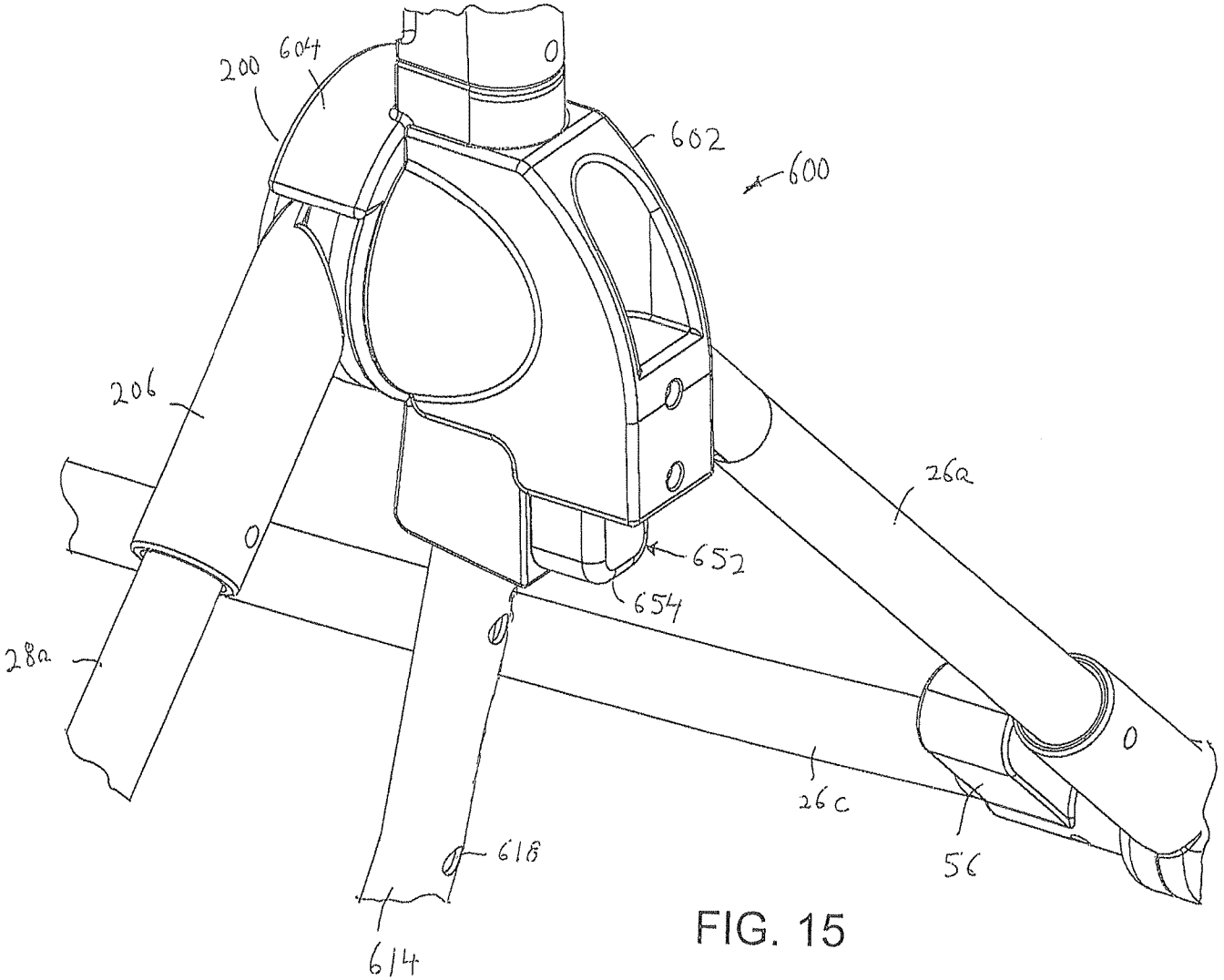
FIG. 15 is a perspective view of the transverse inclination adjustment assembly at the left side of the frame.
Figure 16:
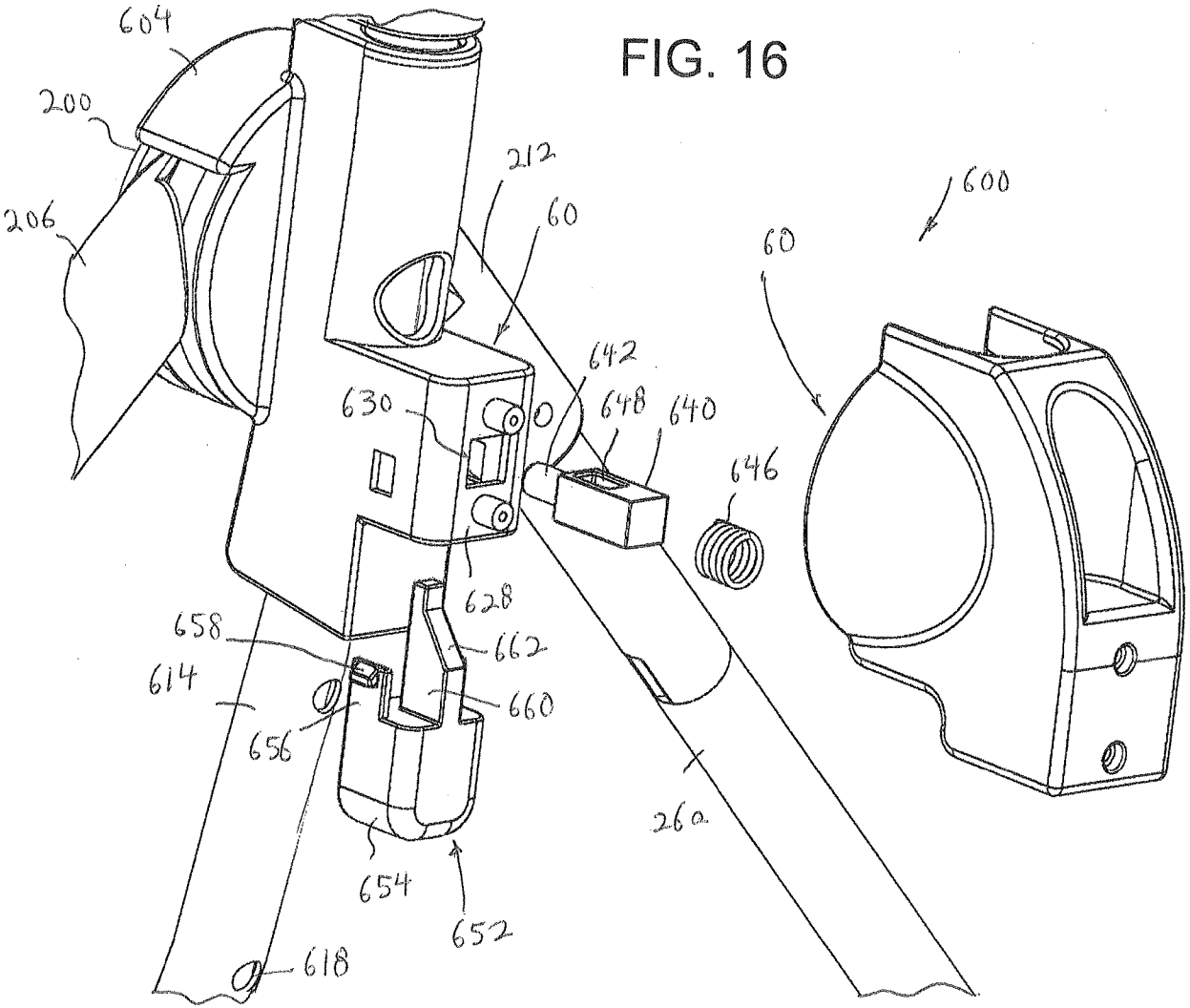
FIG. 16 is an exploded perspective view of the transverse inclination adjustment assembly.

Specifically, lower pivotable base frame 16 includes a first U-shaped tube assembly 26, a second U-shaped tube assembly 28 and a pivoting connection assembly 34 connecting together U-shaped tube assemblies 26 and 28 for pivoting movement between an open position where the U-shaped tube assemblies 26 and 28 form an inverted V-shape as shown in FIG. 2 and a collapsed, closed position where the U-shaped tube assemblies 26 and 28 are parallel and adjacent to each other as shown in FIG. 14B.

First U-shaped tube assembly 26 includes a left tube section 26*a*, a spaced apart parallel right tube section 26*b* and a connecting tube section 26*c* which connects together the lower ends of left and right tube sections 26*a* and 26*b*. Connecting tube section 26*c* is slightly curved to permit transverse rocking back and forth of frame 12 in the fully open position, that is, from left to right and right to left.

In like manner, second U-shaped tube assembly 28 includes a left tube section 28*a*, a spaced apart parallel right tube section 28*b* and a connecting tube section 28*c* which connects together the lower ends of left and right tube sections 28*a* and 28*b*. Connecting tube section 28*c* is also slightly curved to permit transverse rocking back and forth of frame 12 in the fully open position, that is, from left to right and right to left.

Transverse rocking control assemblies 40 rotatably connect opposite ends of connecting tube section 26*c* to the respective lower ends of left and right tube sections 26*a* and 26*b*, and other transverse rocking control assemblies 40 rotatably connect opposite ends of connecting tube section 28*c* to the respective lower ends of left and right tube sections 28*a* and 28*b*.

As shown best in FIGS. 18-21, each transverse rocking control assembly 40 includes a rotatable connector 42 having inner and outer coaxial, adjacent cylindrical housings 44 and 46 which are rotatable relative to each other. A connecting tube 48 is connected to and extends radially outward from the outer surface of outer cylindrical housing 46 for receiving the lower end of the respective tube section 26*a*, 26*b*, 28*a*, 28*b* which is fixed thereto by a rivet 50. A connecting tube 52 is connected to and axially extends inwardly from the inner surface of inner cylindrical housing 44 for receiving one end of connecting tube section 26*c*, 28*c* which is fixed thereto by a rivet 54.

A stop extension 56 is fixed to the outer surface of each connecting tube 52 and extends radially outward therefrom. Because of the rotating nature of inner and outer cylindrical housings 44 and 46 relative to each other, connecting tube sections 26*c*, 28*c* and inner cylindrical housings 44 connected thereto, can be rotated relative to outer cylindrical housings 46 between a first rocking position shown in FIG. 2 and a second non-rocking position shown in FIG. 8.

Specifically, in the first rocking position shown in FIG. 2, each connecting tube section 26*c*, 28*c* is convexly curved in a downward manner to permit transverse rocking of adjustable incline sleeper 10. In this position, stop extensions 56 are oriented upwardly away from the floor surface. In the second non-rocking position shown in FIG. 8, each connecting tube section 26*c*, 28*c* is convexly curved in an upward manner and stop extensions 56 are oriented downwardly in a manner to support adjustable incline sleeper 10 on the floor surface, thereby preventing transverse rocking.

Figure 8:
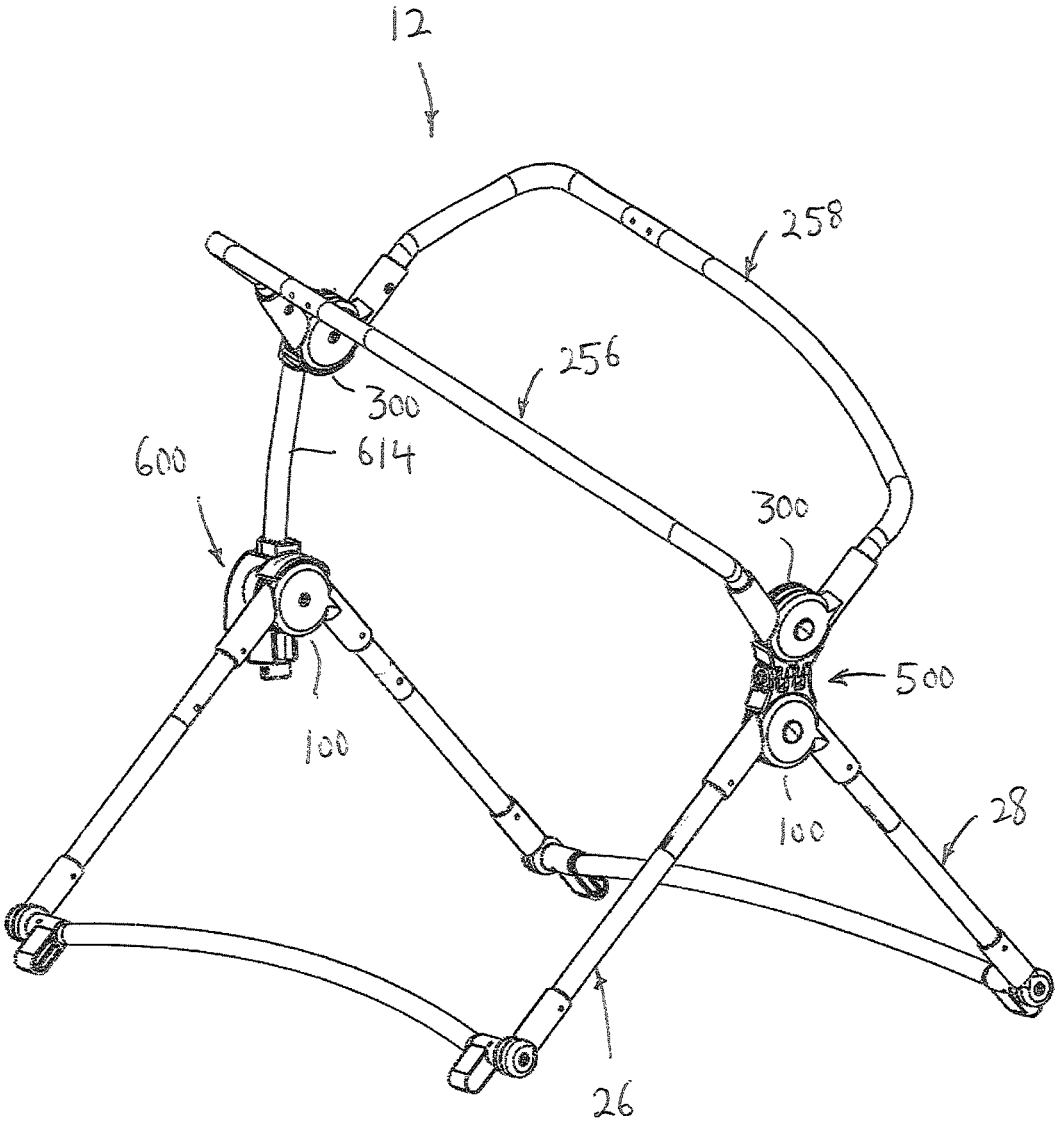
FIG. 8 is a right side perspective view of the frame of the adjustable incline sleeper in a fully opened, non-rockable configuration and at a higher inclination angle.
Figure 9:
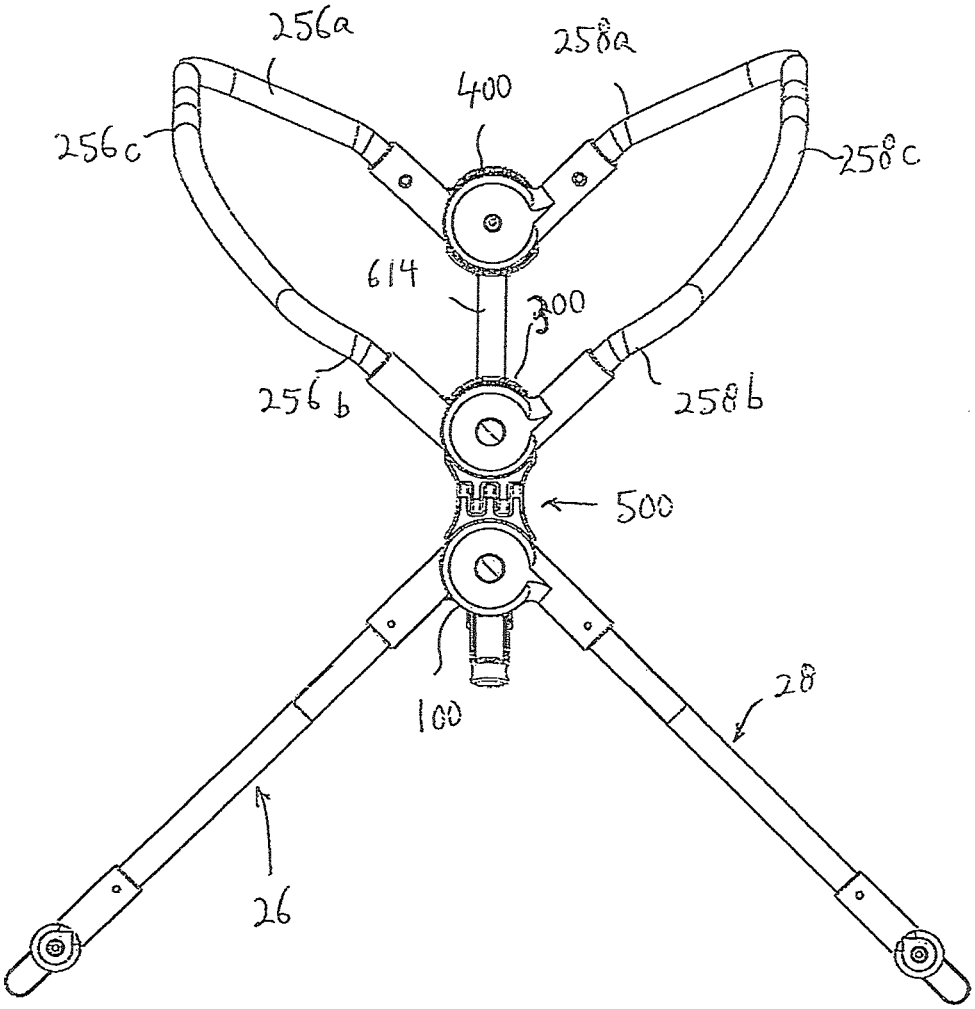
FIG. 9 is a right side elevational view of the adjustable incline sleeper of FIG. 8.
Figure 10:
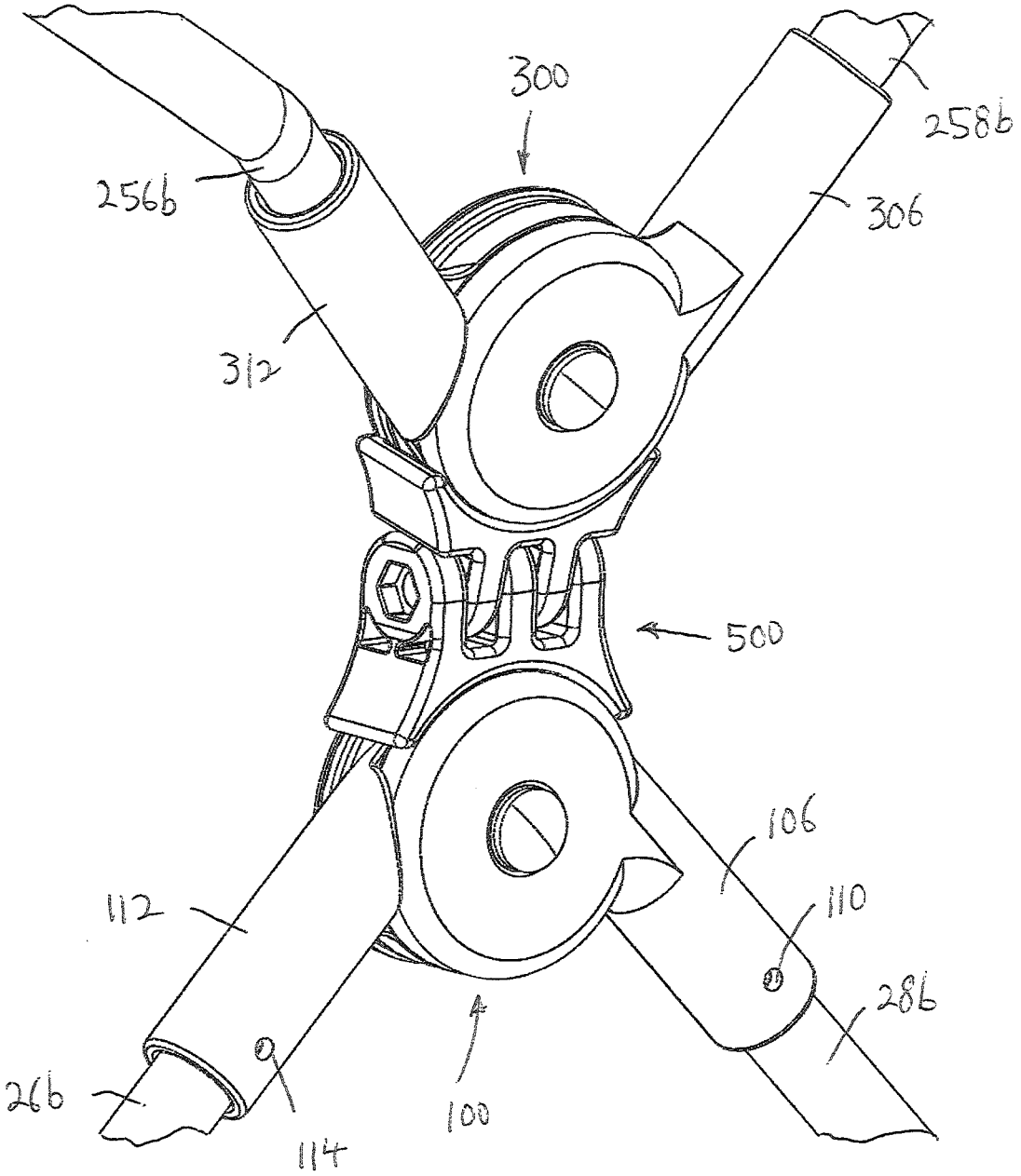
FIG. 10 is an enlarged, perspective view of the pivot assembly at the right side of the frame of FIG. 8.
Figure 11:
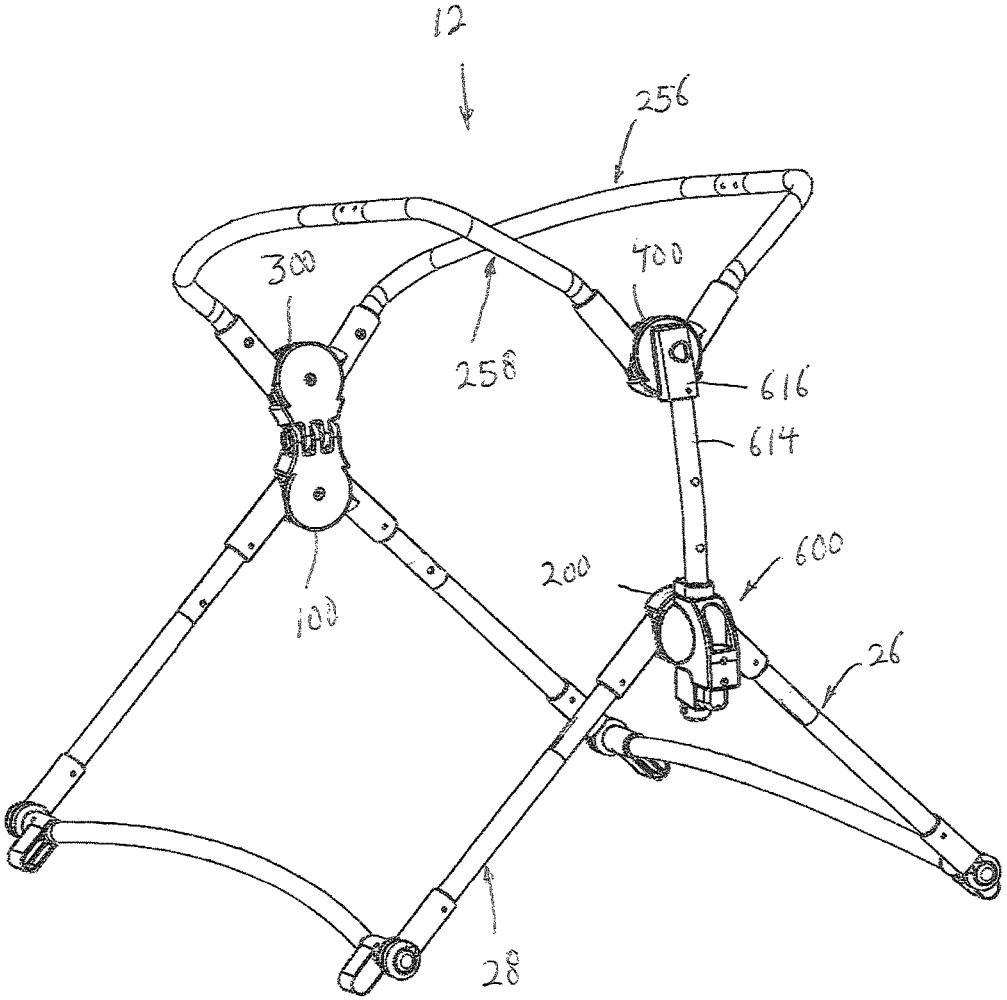
FIG. 11 is a left side perspective view of the adjustable incline sleeper of FIG. 8.
Figure 12:
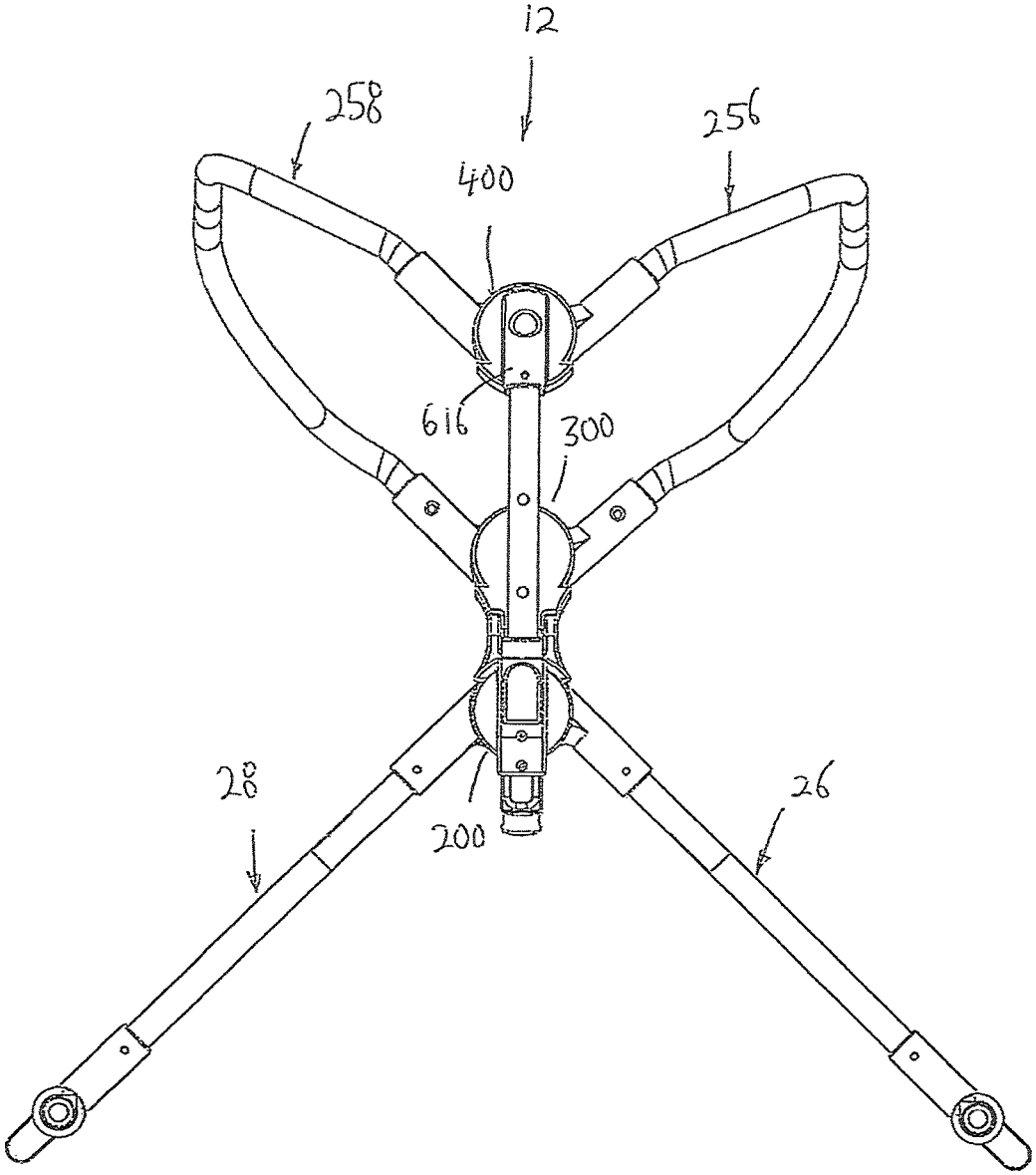
FIG. 12 is a left side elevational view of the adjustable incline sleeper of FIG. 8.
Figure 13:
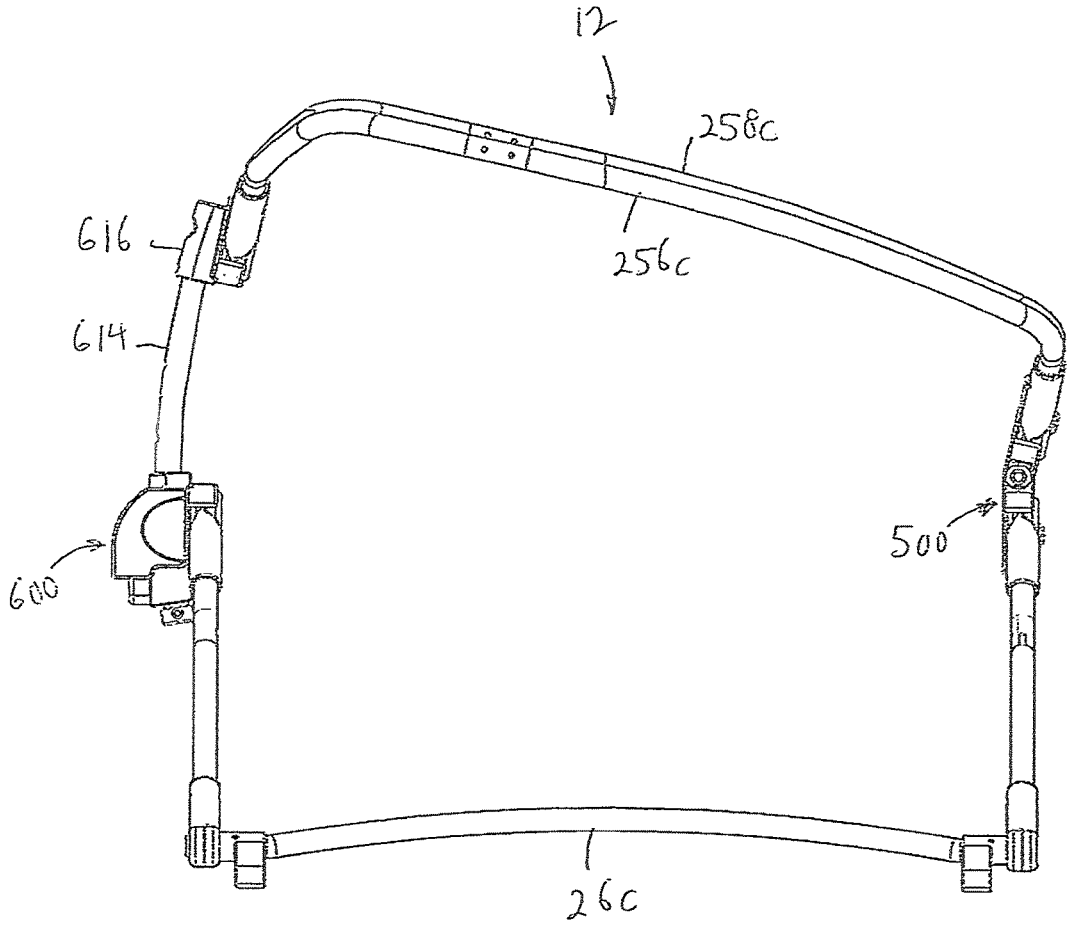
FIG. 13 is a front elevational view of the adjustable incline sleeper of FIG. 8.

In order to permit rotational movement of each connecting tube section 26*c*, 28*c* between the positions shown in FIGS. 2 and 8, and to lock the connecting tube sections 26*c*, 28*c* in their respective positions, each outer cylindrical housing 46 includes an outer circular recess 58 centrally located in the outer axial surface thereof, and the inner surface thereof includes a first locking recess 60 formed by a central circular recess section 62 and diametrically opposite outer recess sections 64 in open communication with circular recess section 62. Recess sections 64 can have any suitable shape, for example, a substantially rectangular shape or the like. As a result, a central dividing wall 66 separates outer circular recess 58 from first locking recess 60.

Four equiangularly spaced arcuate openings 68 are formed in central dividing wall 66 within the boundaries of central circular recess section 62.

A pushbutton 70 having a circular head 72 with dimensions slightly smaller than the diameter of outer circular recess 58, is slidably position within outer circular recess 58. Four equiangularly spaced legs 74 extend at right angles from the inner surface of circular head 72, with outwardly turned catches 76 at the free ends thereof. Legs 74 fit within openings 68, and catches 76 prevent escape of legs 74 from openings 68, while permitting axial sliding movement of legs 74 within openings 68.

A locking member 78 is provided, having a central annular section 80 of the same dimensions as central circular recess section 62, and diametrically opposite outer sections 82 of the same dimensions as outer recess sections 64, such that locking member 78 is adapted to be positioned within first locking recess 60. Locking member 78 also includes an outer closure wall 79 connected to the outer edges of central annular section 80 and outer sections 82.

The outer axial surface of inner annular housing 44 includes a second locking recess 84 formed by a central circular recess section 86 and diametrically opposite outer recess sections 88 in open communication with circular recess section 86. Circular recess section 86 and outer recess sections 88 have the same shapes and dimensions as circular recess section 62 and outer recess sections 64. As a result, locking member 78 also fits within second locking recess 84.

Figure 20:
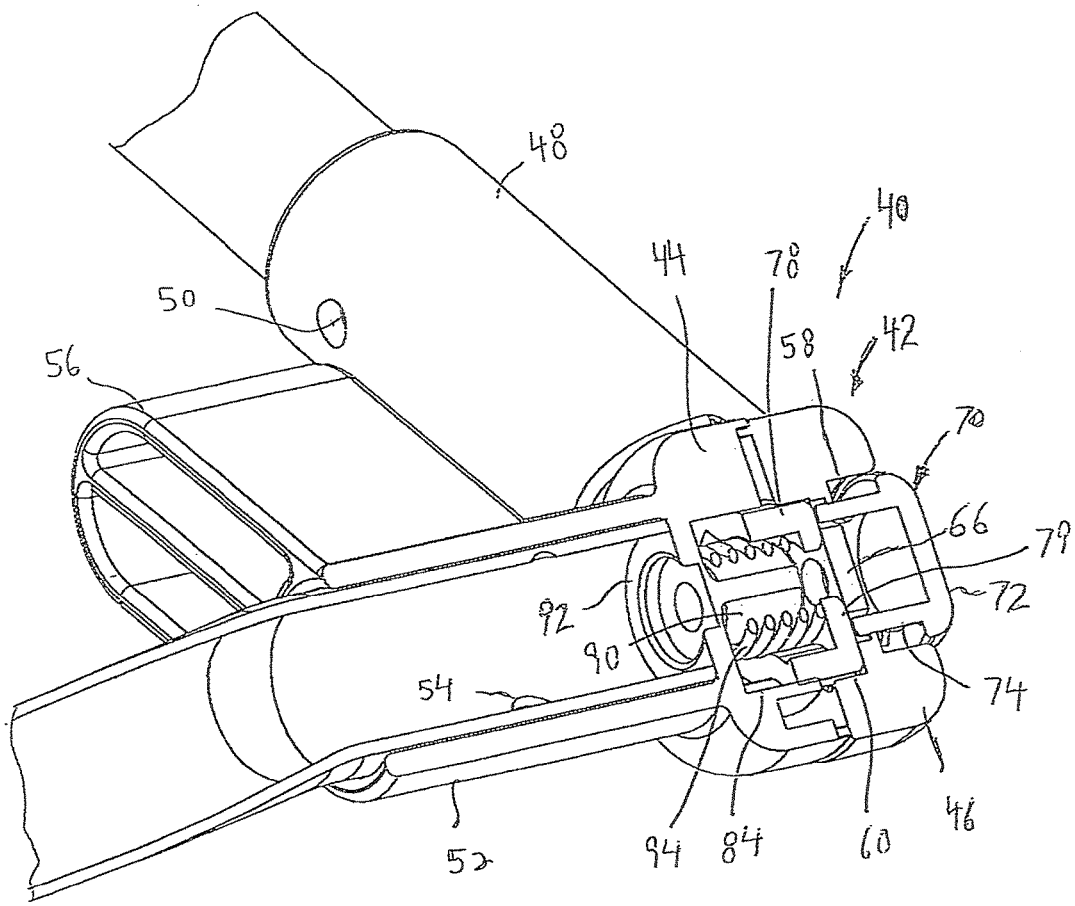
FIG. 20 is an enlarged cross-sectional view of the transverse rocking control assembly with the stop extension thereof in a raised position.
Figure 21:
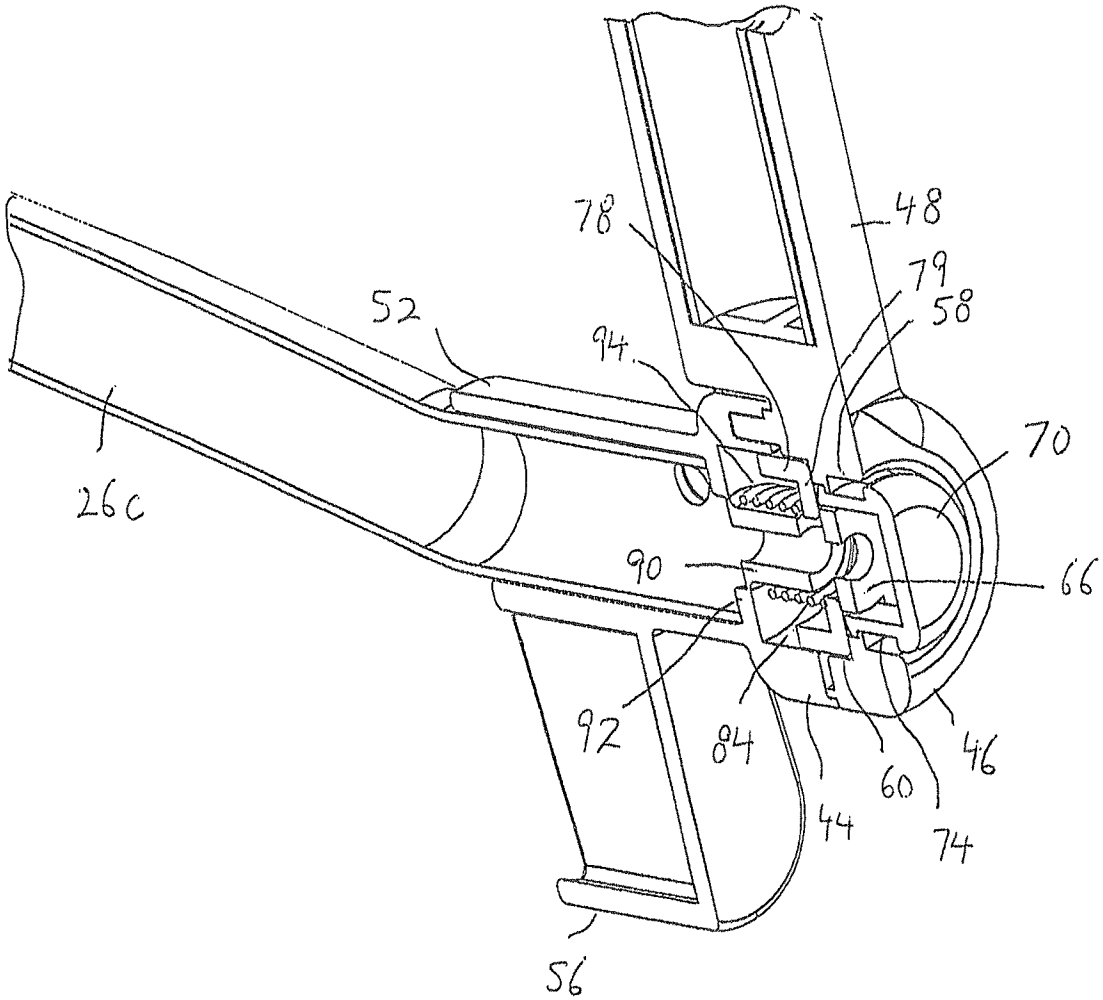
FIG. 21 is an enlarged cross-sectional view of the transverse rocking control assembly with the stop extension thereof in a lowered position.
Figure 22:
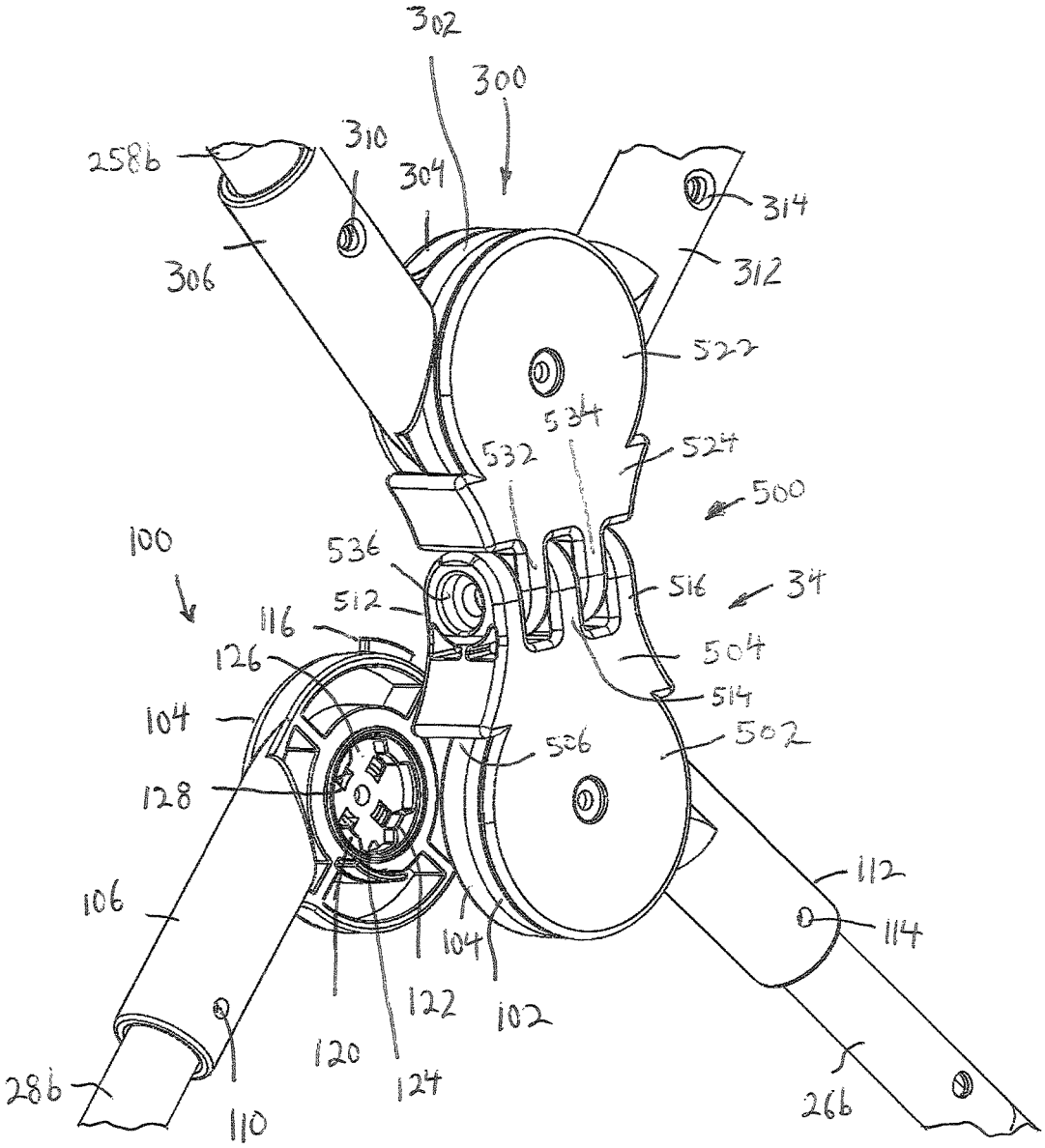
FIG. 22 is an enlarged perspective view of the right side cylindrical pivot assembly and hinge assembly in an open position of the frame.
Figure 23:
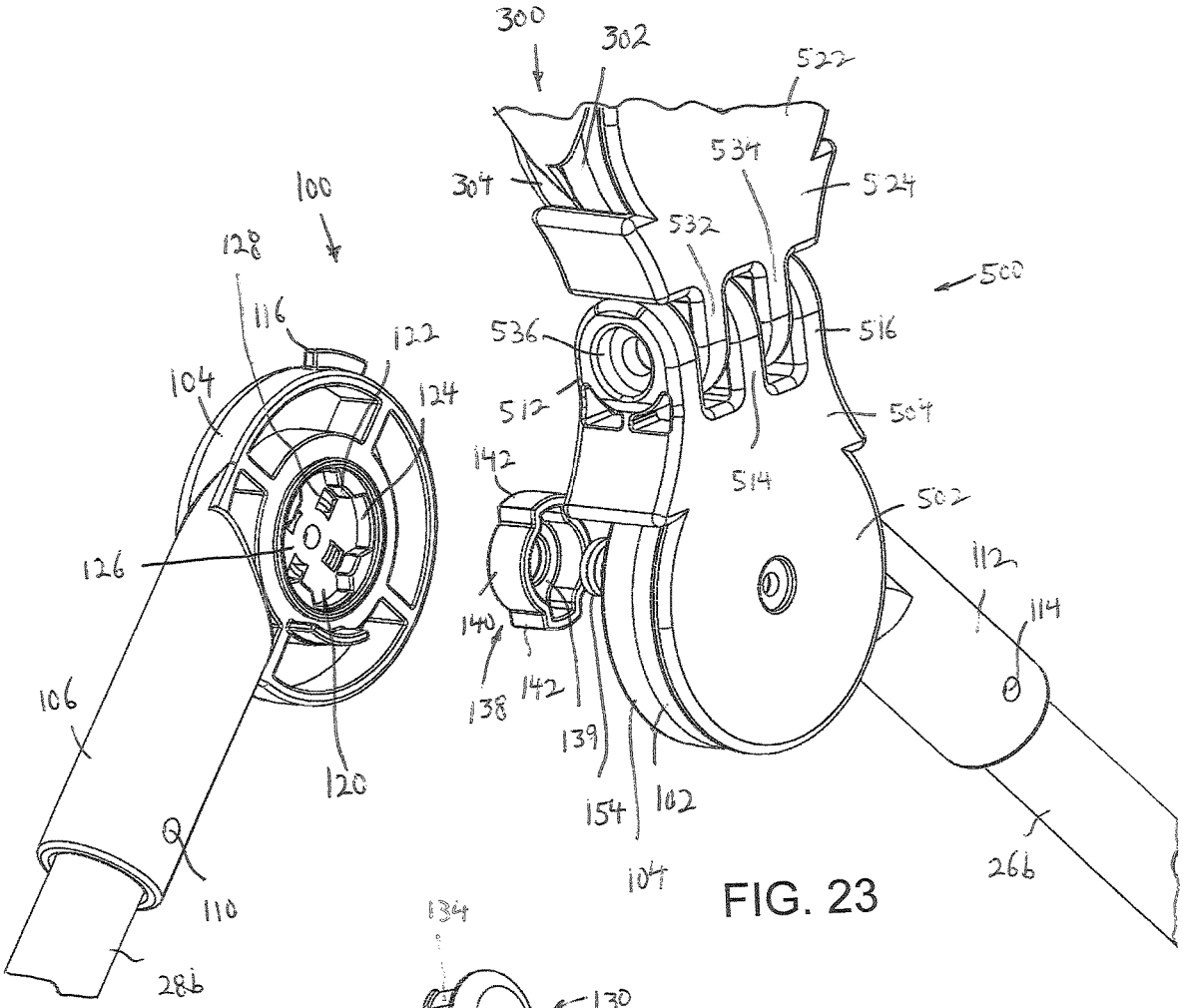
FIG. 23 is an enlarged, blown apart, perspective view of the right side cylindrical pivot assembly, viewed from the inside.
Figure 24:
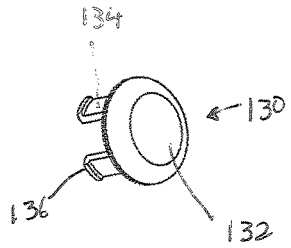
FIG. 24 is a perspective view of the pushbutton.
Figure 25:
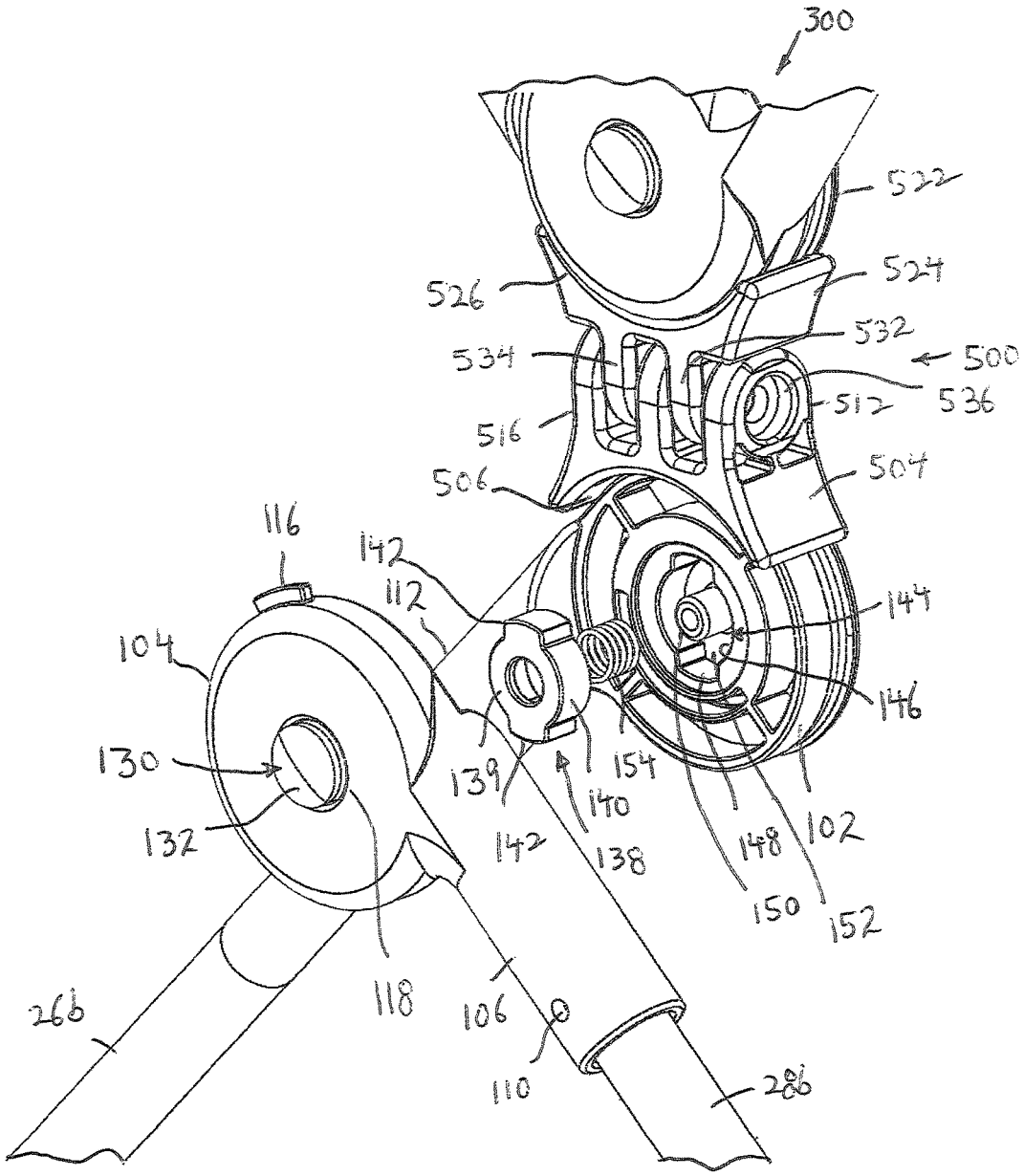
FIG. 25 is an enlarged, blown apart, perspective view of the right side cylindrical pivot assembly, viewed from the outside.
Figure 26:
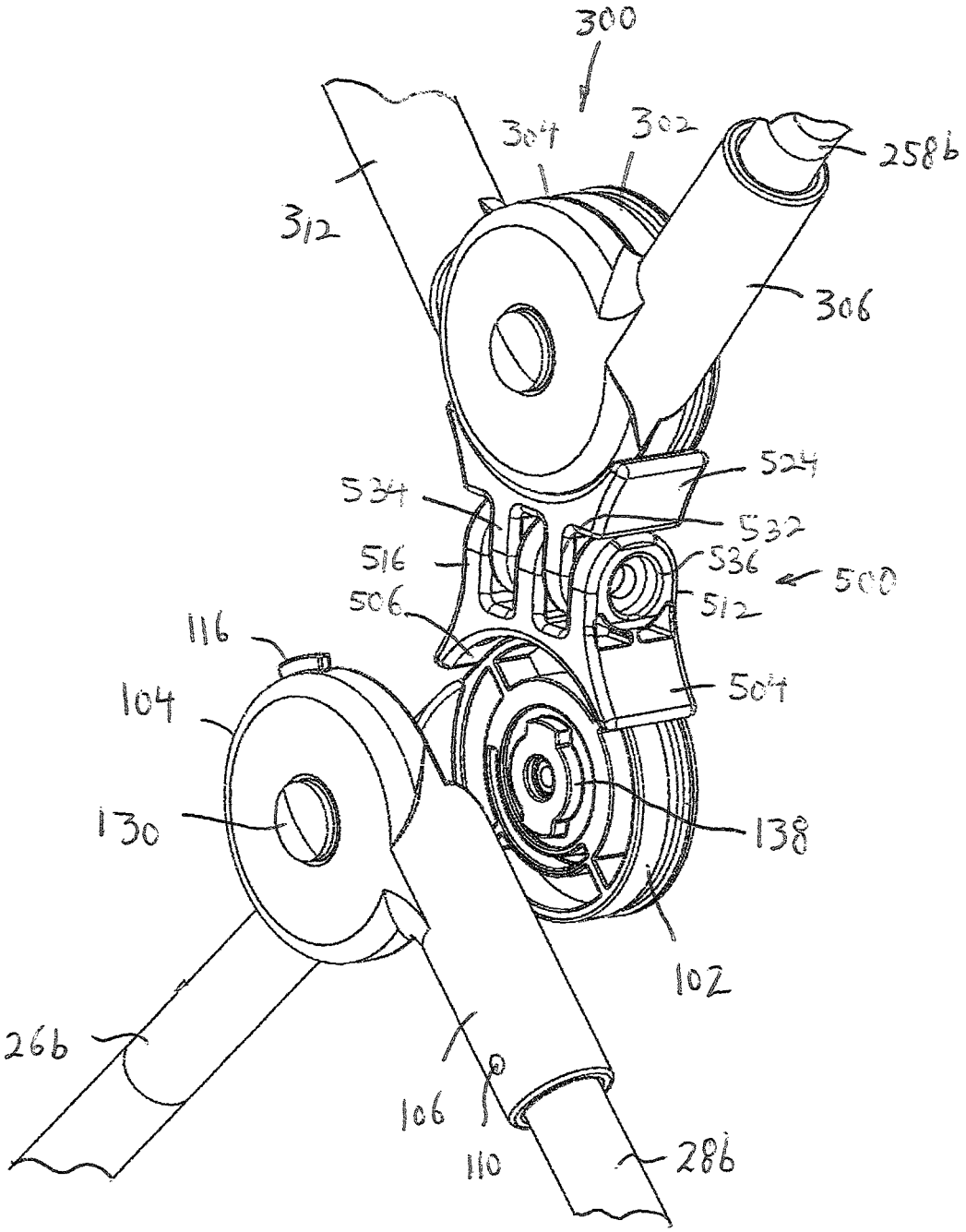
FIG. 26 is an enlarged, perspective view of the right side cylindrical pivot assembly, viewed from the outside, with the inner and outer cylindrical housings being separated from each other.
Figure 27:
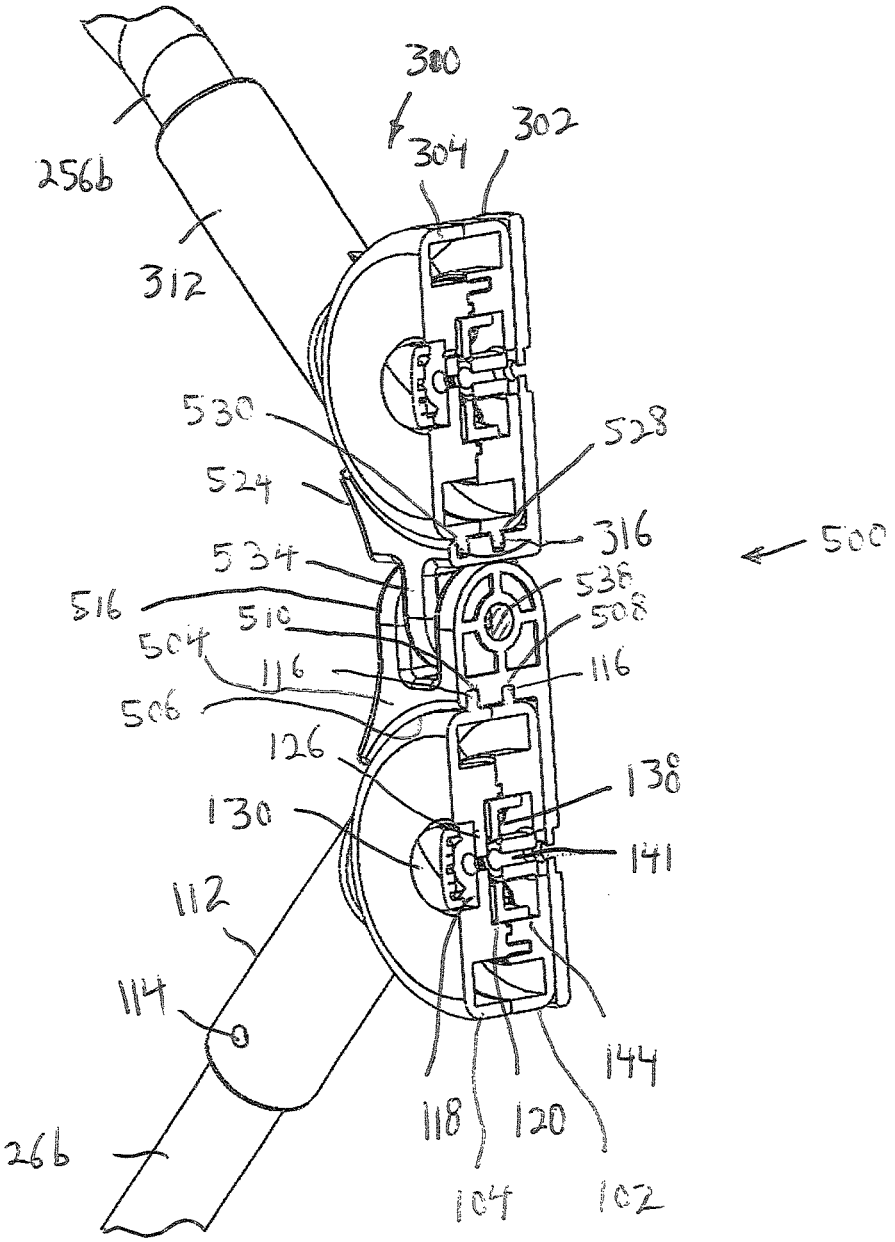
FIG. 27 is a vertical cross-sectional view of the right side cylindrical pivot assembly and hinge assembly of FIG. 22.
Figure 28:
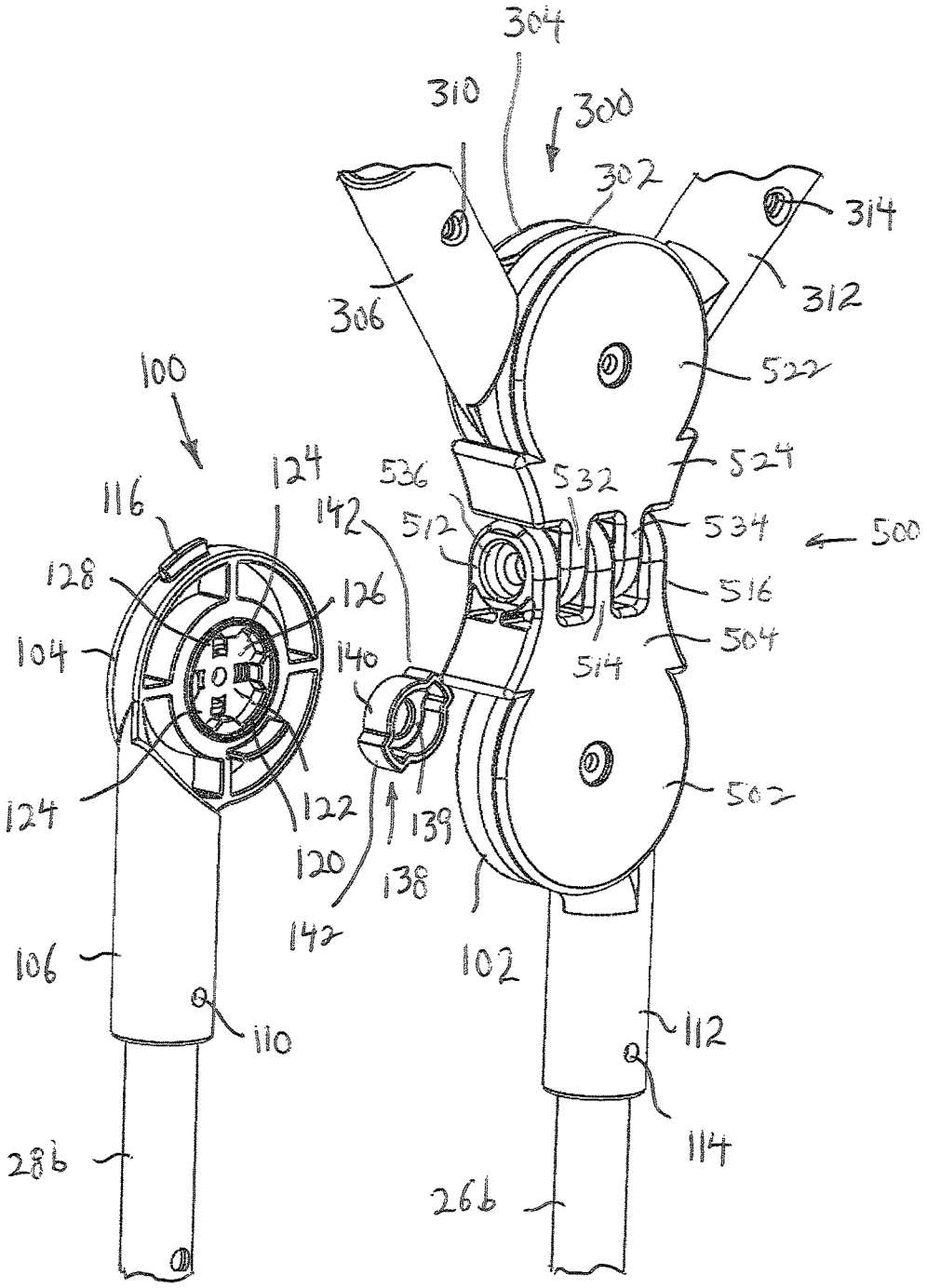
FIG. 28 is an enlarged, blown apart, perspective view of the right side cylindrical pivot assembly, viewed from the inside, in a closed position of the frame.
Figure 29:
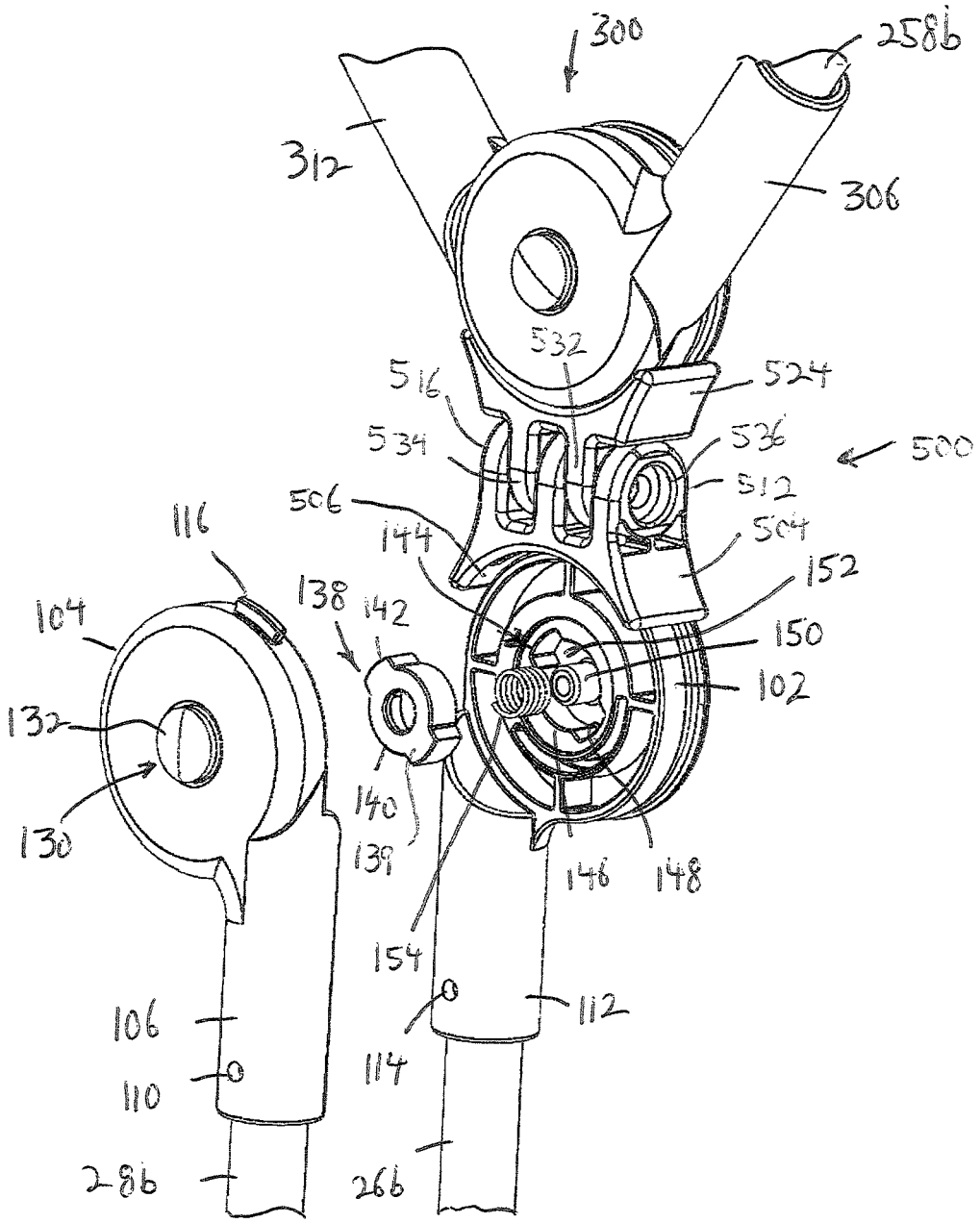
FIG. 29 is an enlarged, blown apart, perspective view of the right side cylindrical pivot assembly, viewed from the outside, in a closed position of the frame.

A central post 90 extends axially from the inner wall 92 of second locking recess 84, and specifically, is centrally located within circular recess section 86 thereof. A coil spring 94 is positioned around central post 90 and extends between closure wall 79 and inner wall 92 so as to normally bias locking member 78 into first locking recess 60. In this position, as shown in FIGS. 20 and 21, locking member 78 is also positioned within second locking recess 84, thereby preventing rotation of inner and outer circular housings 44 and 46 relative to each other. This would correspond to either rotation of the respective connecting tube section 26*c*, 28*c* in the position shown in FIG. 2 or FIG. 8.

When it is desired to rotate the respective connecting tube section 26*c*, 28 to the other position, pushbutton 70 is pushed inwardly, whereby free ends of legs 74 thereof push locking member 78 inwardly so that locking member 78 is fully positioned within second locking recess 84 and is completely out of first locking recess 60, thereby permitting relative rotation between inner and outer annular housings 44 and 46. Once pushbutton 70 is released, coil spring 94 biases locking member 78 back into engagement with both first locking recess 60 and second locking recess 84 to again prevent rotation of inner and outer circular housings 44 and 46 relative to each other.

As shown best in FIGS. 22-29, pivoting connection assembly 34 includes a lower right side cylindrical pivot assembly 100 including inner and outer coaxial, adjacent cylindrical housings 102 and 104 which are rotatable relative to each other. A connecting tube 106 is connected to and extends radially down from the outer surface of outer cylindrical housing 104 for receiving the upper end of the tube section 28*b* which is fixed thereto by a rivet 110. A connecting tube 112 is connected to and extends radially down from the outer surface of inner cylindrical housing 102 for receiving the upper end of the tube section 26*b* which is fixed thereto by a rivet 114. Because of the rotating nature of inner and outer cylindrical housings 102 and 104 relative to each other, connecting tube sections 26*b* and 28*b* can be pivoted between a first open position shown in FIG. 2 and a second collapsed position shown in FIG. 14B.

Each cylindrical housing 102 and 104 includes an upper arcuate projection 116 which extends upwardly from the outer surface thereof, for fitting within arcuate slots (as will be described hereafter), to maintain cylindrical housings 102 and 104 in their coaxial, adjacent positions and to limit the pivoting extent thereof between the positions shown in FIGS. 2 and 14B.

In order to permit pivotal movement of tube sections 26*a*, 26*b*, 28*a*, 28*b* between the positions shown in FIGS. 2 and 14B, and to lock the tube sections 26*a*, 26*b*, 28*a*, 28*b* in their respective positions, each outer cylindrical housing 104 includes an outer facing circular recess 118 centrally located in the outer facing axial surface thereof, and the inner surface thereof includes a first locking recess 120 formed by a central circular recess section 122 and four equiangularly arranged outer recess sections 124 in open communication with circular recess section 122. Recess sections 124 can have any suitable shape, for example, a substantially rectangular shape or the like. As a result, a central dividing wall 126 separates outer circular recess 118 from first locking recess 120.

Four equiangularly spaced arcuate openings 128 are formed in central dividing wall 126 within the boundaries of central circular recess section 122.

A pushbutton 130 having a circular head 132 with dimensions slightly smaller than the diameter of outer circular recess 118, is slidably positioned within inner circular recess 118. Four equiangularly spaced legs 134 extend at right angles from circular head 132, with outwardly turned catches 136 at the free ends thereof. Legs 134 fit within openings 128, and catches 136 prevent escape of legs 134 from openings 128, while permitting axial sliding movement of legs 134 within openings 128.

A locking member 138 is provided, having a central annular section 140 of the same dimensions as central circular recess section 122, and diametrically opposite outer sections 142 of the same dimensions as outer recess sections 124, such that locking member 138 is adapted to be positioned within first locking recess 120. Locking member 138 also includes an inner closure wall 139 connected to the outer facing edges of central annular section 140 and outer sections 142.

The outer facing axial surface of inner annular housing 102 includes a second locking recess 144 formed by a central circular recess section 146 and diametrically opposite outer recess sections 148 in open communication with circular recess section 146. Circular recess section 146 and outer recess sections 148 have the same shapes and dimensions as circular recess section 122 and outer recess sections 124. As a result, locking member 138 also fits within second locking recess 144.

A central post 150 extends axially from the lower wall 152 of second locking recess 144, and specifically, is centrally located within circular recess section 146 thereof. A coil spring 154 is positioned around central post 150 and extends between closure wall 139 and lower wall 152 so as to normally bias locking member 138 into first locking recess 120. In this position, locking member 138 is also positioned within second locking recess 144, thereby preventing rotation of inner and outer circular housings 102 and 104 relative to each other. This would correspond to pivoting of tube sections 26*a*, 26*b*, 28*a*, 28*b* in the position shown in FIG. 2 or FIG. 14B.

Lastly, a pivot rod 141 (FIG. 27) is axially positioned centrally within axial openings in cylindrical housings 102 and 104 about which cylindrical housings 102 and 104 rotate relative to each other, and which further maintain cylindrical housings 102 and 104 in their axial rotatable positions relative to each other.

When it is desired to rotate the respective tube sections 26*a*, 26*b*, 28*a*, 28*b* to the other position, pushbutton 130 is pushed inwardly, whereby free ends of legs 134 thereof push locking member 138 inwardly so that locking member 138 is fully positioned within second locking recess 144 and is completely out of first locking recess 120, thereby permitting relative rotation between inner and outer annular housings 102 and 104. Once pushbutton 130 is released, coil spring 154 biases locking member 138 back into engagement with both first locking recess 120 and second locking recess 144 to again prevent rotation of inner and outer circular housings 102 and 104 relative to each other.

Figure 30:
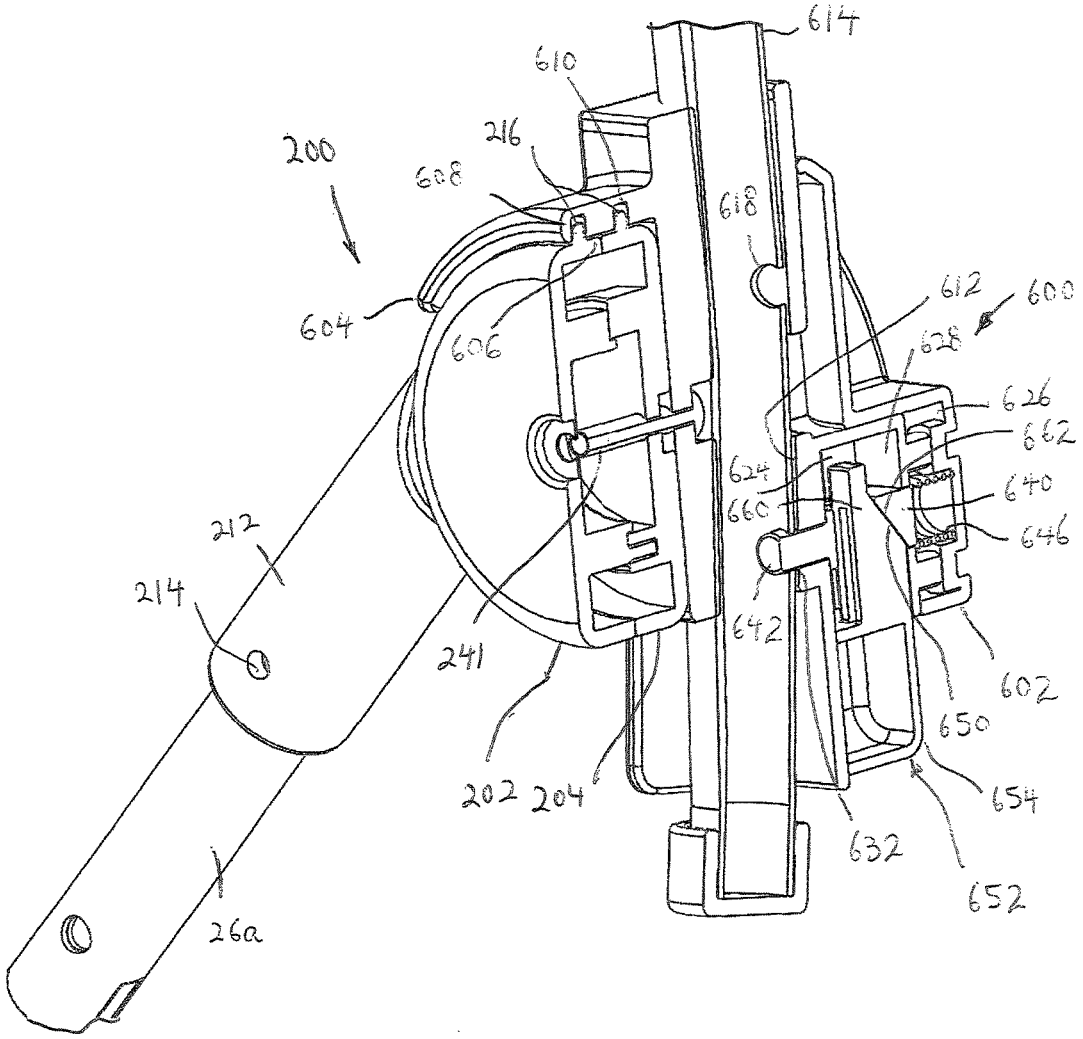
FIG. 30 is an enlarged perspective view of the left side cylindrical pivot assembly.

As shown best in FIGS. 2 and 30, pivoting connection assembly 34 further includes a lower left side cylindrical pivot assembly 200 including inner and outer coaxial, adjacent cylindrical housings 202 and 204 which are rotatable relative to each other. A connecting tube 206 is connected to and extends radially down from the outer surface of outer cylindrical housing 204 for receiving the upper end of the tube section 28*a* which is fixed thereto by a rivet 210. A connecting tube 212 is connected to and extends radially down from the outer surface of inner cylindrical housing 202 for receiving the upper end of the tube section 26*a* which is fixed thereto by a rivet 214. Because of the rotating nature of inner and outer cylindrical housings 202 and 204 relative to each other, connecting tube sections 26*a* and 28*a* can be pivoted between a first open position shown in FIG. 2 and a second collapsed position shown in FIG. 14B.

Each cylindrical housing 202 and 204 includes an upper arcuate projection 216 which extends upwardly from the outer surface thereof, for fitting within arcuate slots (as will be described hereafter), to maintain cylindrical housings 202 and 204 in their coaxial, adjacent positions and to limit the pivoting extent thereof between the positions shown in FIGS. 2 and 14B.

Lastly, a pivot rod 241 is axially positioned centrally within axial openings in cylindrical housings 202 and 204 about which cylindrical housings 202 and 204 rotate relative to each other, and which further maintain cylindrical housings 202 and 204 in their axial rotatable positions relative to each other.

It will be appreciated that the locking mechanism of lower right side cylindrical pivot assembly 100 is not required with lower left side cylindrical pivot assembly 200, since the locking mechanism only need be provided on one side of frame 12.

Upper pivotable base frame 18 includes a first U-shaped tube assembly 256, a second U-shaped tube assembly 258 and a pivoting connection assembly 254 connecting together U-shaped tube assemblies 256 and 258 for pivoting movement between an open position where the U-shaped tube assemblies 256 and 258 form a V-shape as shown in FIG. 2 and a collapsed, closed position where the U-shaped tube assemblies 256 and 258 are parallel and adjacent to each other as shown in FIG. 14B.

First U-shaped tube assembly 256 includes a left tube section 256*a*, a spaced apart parallel right tube section 256*b* and a connecting tube section 256*c* which connects together the upper ends of left and right tube sections 256*a* and 256*b*. In like manner, second U-shaped tube assembly 258 includes a left tube section 258*a*, a spaced apart parallel right tube section 258*b* and a connecting tube section 258*c* which connects together the upper ends of left and right tube sections 258*a* and 258*b*.

Flexible covering body 14 has opposite ends connected to connecting tube sections 256*c* and 258*c* by any conventional means, such as stitching, snaps, Velcro or the like.

Pivoting connection assembly 254 includes an upper right side cylindrical pivot assembly 300 including inner and outer coaxial, adjacent cylindrical housings 302 and 304 which are rotatable relative to each other. A connecting tube 306 is connected to and extends radially up from the outer surface of outer cylindrical housing 304 for receiving the upper end of the tube section 258*b* which is fixed thereto by a rivet 310. A connecting tube 312 is connected to and extends radially up from the outer surface of inner cylindrical housing 302 for receiving the upper end of the tube section 256*b* which is fixed thereto by a rivet 314. Because of the rotating nature of inner and outer cylindrical housings 302 and 304 relative to each other, connecting tube sections 256*b* and 258*b* can be pivoted between a first open position shown in FIG. 2 and a second collapsed position shown in FIG. 14B.

Each cylindrical housing 302 and 304 includes a lower arcuate projection 316 (FIG. 27) which extends downwardly from the outer surface thereof, for fitting within arcuate slots (as will be described hereafter), to maintain cylindrical housings 302 and 304 in their coaxial, adjacent positions and to limit the pivoting extent thereof between the positions shown in FIGS. 2 and 14B.

Right side cylindrical pivot assembly 300 is constructed in an identical manner, and operates in the same manner as right side cylindrical pivot assembly 100 so that a detailed description thereof is omitted, except that right side cylindrical pivot assembly 300 is inverted 180 degrees from right side cylindrical pivot assembly 100.

Pivoting connection assembly 254 further includes an upper left side cylindrical pivot assembly 400 including inner and outer coaxial, adjacent cylindrical housings 402 and 404 (FIG. 17) which are rotatable relative to each other. A connecting tube 406 is connected to and extends radially up from the outer surface of outer cylindrical housing 404 for receiving the upper end of the tube section 258*a* which is fixed thereto by a rivet 410. A connecting tube 412 is connected to and extends radially up from the outer surface of inner cylindrical housing 402 for receiving the upper end of the tube section 256*a* which is fixed thereto by a rivet 414. Because of the rotating nature of inner and outer cylindrical housings 402 and 404 relative to each other, connecting tube sections 256*a* and 258*a* can be pivoted between a first open position shown in FIG. 2 and a second collapsed position shown in FIG. 14B.

Left side cylindrical pivot assembly 400 is constructed in an identical manner, and operates in the same manner as left side cylindrical pivot assembly 200 so that a detailed description thereof is omitted, except that left side cylindrical pivot assembly 400 is inverted 180 degrees from left side cylindrical pivot assembly 200.

As shown best in FIGS. 22-29, transverse pivotable connection arrangement 24 includes a right side pivot connection 500 for pivotally connecting together lower and upper right side cylindrical pivot assemblies 100 and 300 for transverse pivotal movement. Specifically, right side pivot connection 500 includes a lower circular backing plate 502 of the same diameter as inner cylindrical housing 102 and positioned coaxially at the rear, inner facing surface of inner cylindrical housing 102. A lower pivot mounting housing 504 has its lower end fixed to the upper surface of lower circular backing plate 502 and forms a continuation of lower circular backing plate 502, while also extending outwardly from the upper end thereof in the axial direction thereof. Lower pivot mounting housing 504 has a bottom arcuate surface 506 of the same radius as cylindrical housings 102 and 104, and is positioned directly above cylindrical housings 102 and 104.

Two parallel arcuate slots 508 and 510 are formed through bottom arcuate surface 506 for receiving upper arcuate projections 116 of cylindrical housings 102 and 104 so as to prevent axial displacement of cylindrical housings 102 and 104 relative to each other. The ends of arcuate slots 508 and 510 function also to limit the arcuate travel of upper arcuate projections 116, and thereby, the rotational movement of cylindrical housings 102 and 104, and first and second U-shaped tube assemblies 26 and 28 connected thereto.

Three parallel, spaced apart finger plates 512, 514, 516 extend upwardly from lower pivot mounting housing 504.

Right side pivot connection 500 further includes an upper circular backing plate 522 of the same diameter as inner cylindrical housing 302 and positioned coaxially at the rear, inner facing surface of inner cylindrical housing 302. An upper pivot mounting housing 524 has its upper end fixed to the lower surface of upper circular backing plate 522 and forms a continuation of upper circular backing plate 522, while also extending outwardly from the upper end thereof in the axial direction thereof. Upper pivot mounting housing 524 has an upper arcuate surface 526 of the same radius as cylindrical housings 302 and 304, and is positioned directly below cylindrical housings 302 and 304.

Two parallel arcuate slots 528 and 530 are formed through bottom arcuate surface 526 for receiving lower arcuate projections 316 of cylindrical housings 302 and 304 so as to prevent axial displacement of cylindrical housings 302 and 304 relative to each other. The ends of arcuate slots 528 and 530 function also to limit the arcuate travel of lower arcuate projections 316, and thereby, the rotational movement of cylindrical housings 302 and 304, and first and second U-shaped tube assemblies 256 and 258 connected thereto.

Two parallel, spaced apart finger plates 532, 534 extend downwardly from upper pivot mounting housing 524, and are positioned between finger plates 512, 514, 516. Each of finger plates 512, 514, 516, 532, 534 includes a through opening 536 which are all in alignment with each other, and a pin 538 (FIG. 27) is positioned within all through openings 536 to permit transverse rotation or pivoting of upper right side cylindrical pivot assembly 300 relative to lower right side cylindrical pivot assembly 100, between the pivoted positions shown in FIGS. 2-7 on one hand, and FIGS. 8-13 on the other hand.

Transverse pivotable connection arrangement 24 further includes a transverse pivoting adjustment arrangement 600 at the left side of adjustable incline sleeper 10 and connected with left side cylindrical pivot assemblies 200, 400 in order to move left side cylindrical pivot assemblies 200, 400 toward and away from each other, while right side cylindrical pivot assemblies 100, 300 are pivoted relative to each other by right side pivot connection 500.

As shown best in FIGS. 15-17 and 30, transverse pivoting adjustment arrangement 600 includes a housing 602 mounted to the outer axial surface of outer cylindrical housing 204 of lower left side cylindrical pivot assembly 200. An arcuate cowling 604 extends inwardly from the upper end of housing 602 immediately above cylindrical housings 202 and 204. Two parallel arcuate slots 608 and 610 are formed through the bottom arcuate surface 606 of arcuate cowling 604 for receiving upper arcuate projections 216 of cylindrical housings 202 and 204 so as to prevent axial displacement of cylindrical housings 202 and 204 relative to each other. The ends of arcuate slots 608 and 610 function also to limit the arcuate travel of upper arcuate projections 216, and thereby, the rotational movement of cylindrical housings 202 and 204, and first and second U-shaped tube assemblies 26 and 28 connected thereto.

Housing 602 includes a vertically oriented opening 612 therethrough through which an adjustment rod 614 is slidably positioned. The upper end of adjustment rod 614 is fixed in a housing 616 which is fixed to the outer axial surface of upper left side cylindrical pivot assembly 400. Adjustment rod 614 includes a plurality of spaced apart openings 618 therethrough. It will be appreciated that this construction can be reversed in that housing 602 is mounted to upper left side cylindrical pivot assembly 400 and housing 616 is mounted to lower left side cylindrical pivot assembly 200.

Housing 602 includes a first lower chamber 624 to the outside of opening 612, and a second lower chamber 626 to the outside of first lower chamber 624 and separated from first lower chamber 624 by a vertical wall 628. Vertical wall 628 has an opening 630 which serves as a guide, as will now be discussed.

A parallelepiped slide 640 has a retaining pin 642 at one end thereof, with slide 640 being slidingly received within the first and second lower chambers 624 and 626, and guided horizontally by opening 630 in vertical wall 628. The opposite end of first lower chamber 624 includes an opening 632 through which retaining pin 642 is slidably received, and which is adapted to engage within a respective opening 618 in adjustment rod 614. A coil spring 646 is positioned within second lower chamber 626 and engages the end of slide 640 which is opposite retaining pin 642, so as to normally bias retaining pin 642 through opening 632 in first lower chamber 624. In this manner, retaining pin 642 can be selectively positioned in a respective opening 618 so as to adjust the vertical separation between left side cylindrical pivot assemblies 200 and 400.

In order to move retaining pin 622 out of a respective opening 618, so as to enable vertical adjustment between left side cylindrical pivot assemblies 200 and 400, slide 640 is provided with a vertical opening 648, with the wall defining the vertical opening 648 which is closest to coil spring 646, being inclined to form a wedge surface 650.

A release member 652 slidably extends upwardly through the lower end of first lower chamber 624. Release member 652 includes a pushbutton 654 which extends downwardly out from first lower chamber 624. Opposite retaining fingers 656 extend upwardly from pushbutton 654, each including a catch 658 at the free end thereof for engaging within a respective ledge (not shown) in first lower chamber 624 to prevent escape of release member 652 from first lower chamber 624, while permitting sliding movement of release member 652 in first lower chamber 624.

A finger 660 extends upwardly from pushbutton 654 and includes a wedge surface 662 for engaging with wedge surface 650 of slide 640.

Figure 17:
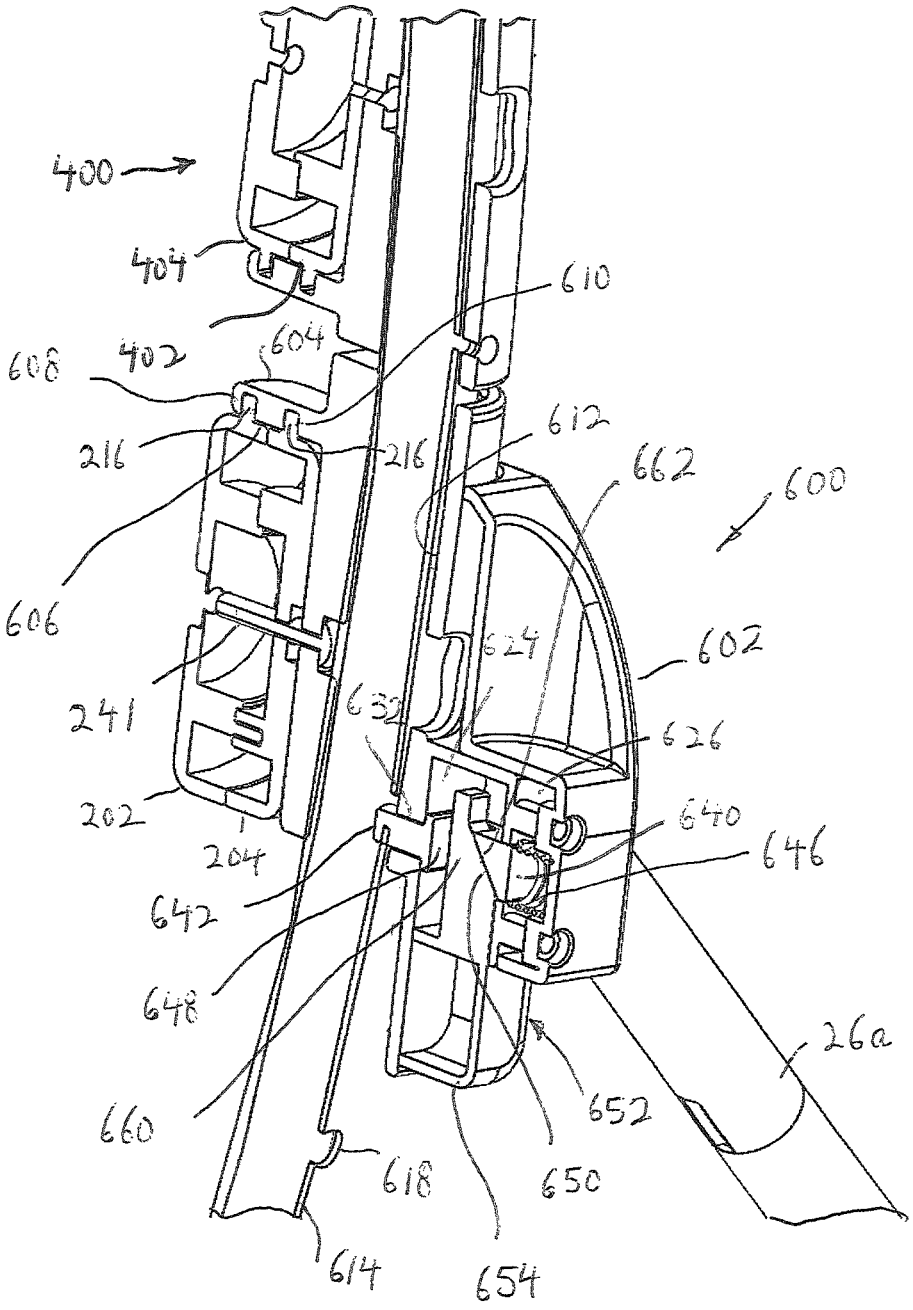
FIG. 17 is a longitudinal cross-sectional view of the transverse inclination adjustment assembly.
Figure 18:
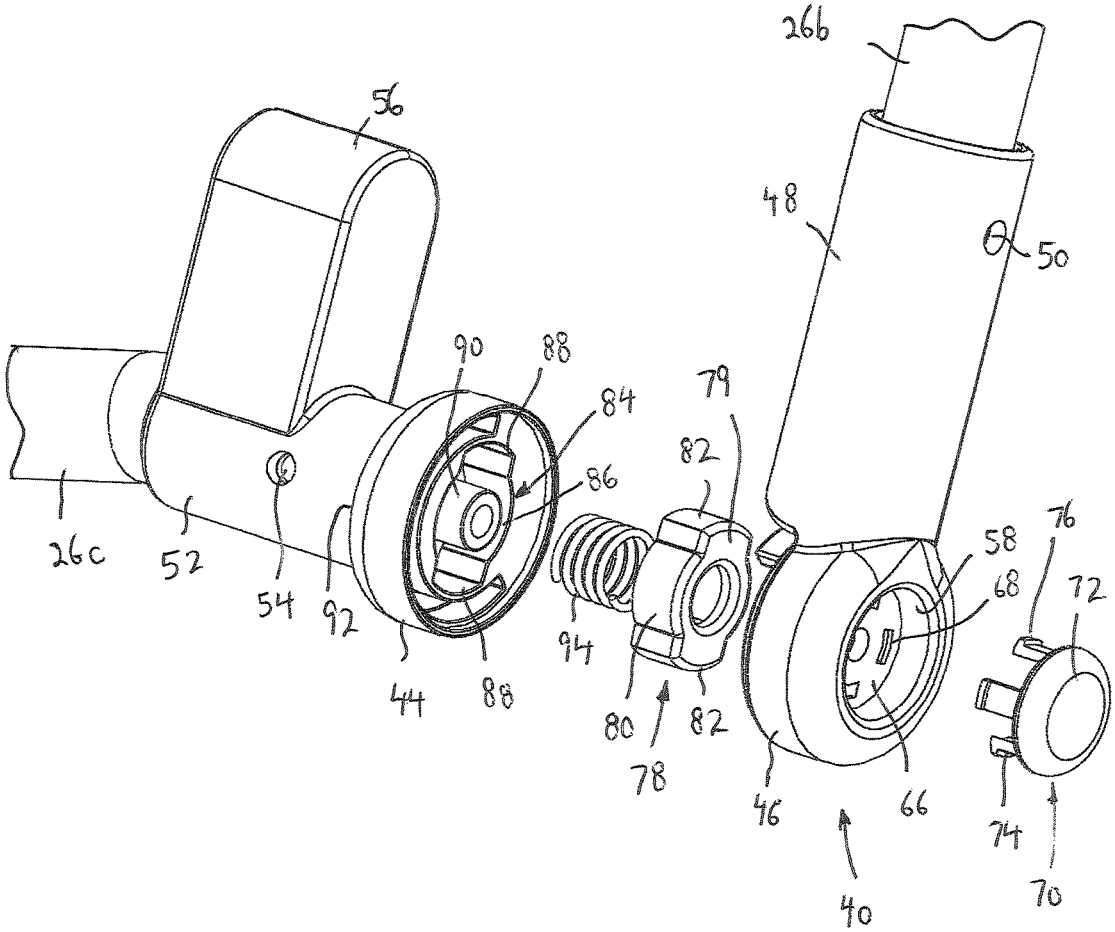
FIG. 18 is an outside, exploded, perspective view of the transverse rocking control assembly, showing the stop extension thereof in a raised position.
Figure 19:
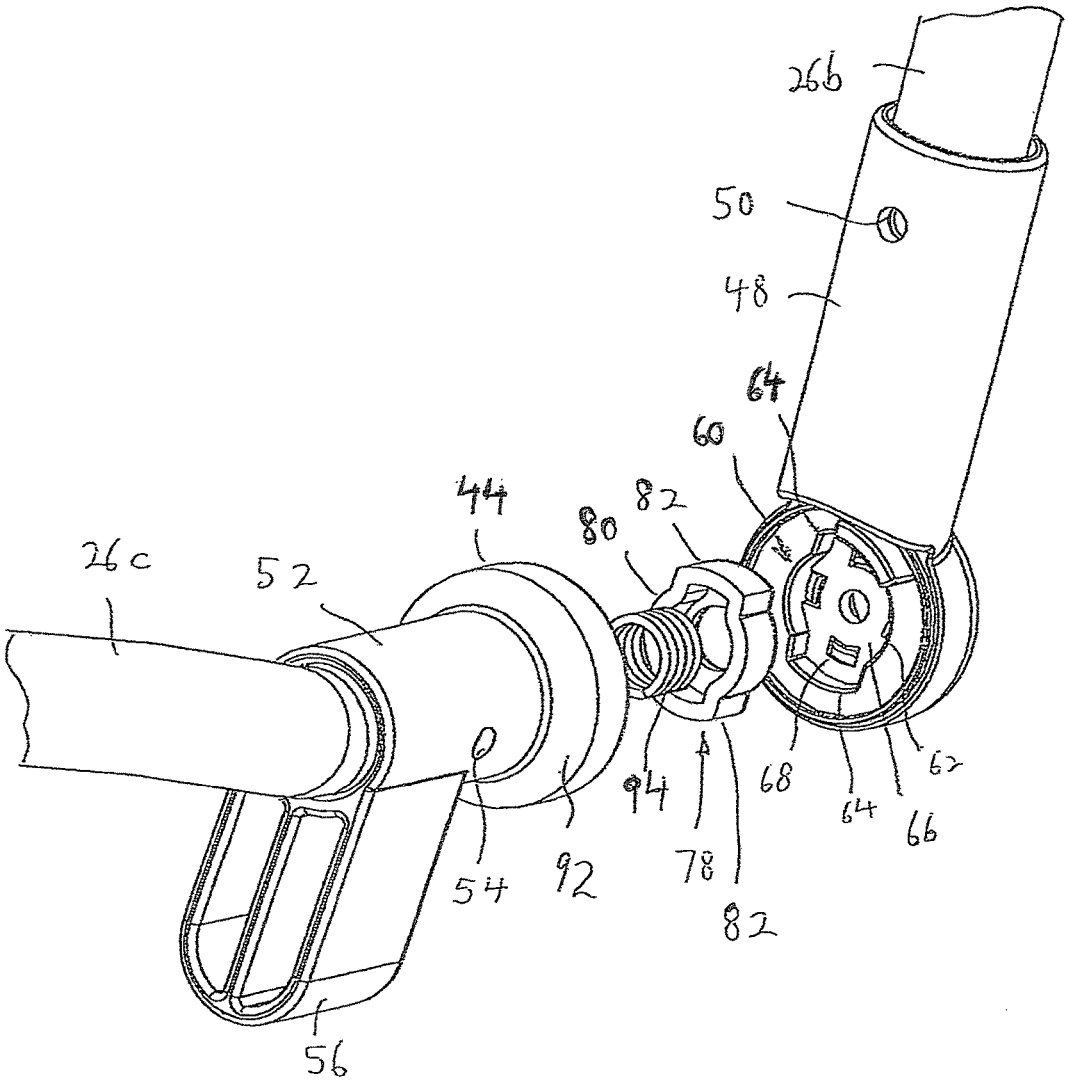
FIG. 19 is an inside, exploded, perspective view of the transverse rocking control assembly, showing the stop extension thereof in a lowered position.

In order to adjust the distance of upper left side cylindrical pivot assembly 400 relative to lower left side cylindrical pivot assembly 200, pushbutton 654 is pressed upwardly so that wedge surface 662 engages wedge surface 662 to move slide 640 to the right in FIG. 17 against the force of coil spring 646, thereby moving retaining pin 642 out of the respective opening 618 in adjustment rod 614. Since adjustment rod 614 is no longer restrained, upper left side cylindrical pivot assembly 400 can be moved vertically relative to lower left side cylindrical pivot assembly 200, to adjust the transverse inclination of upper pivotable support frame 18 relative to lower pivotable support frame 16. When the desired inclination is achieved, pushbutton 654 is released, whereby coil spring 646 biases slide 640 to the left in FIG. 17, whereupon retaining pin 642 engages within another opening 618 of adjustment rod 614, to maintain this new vertical separation between left side cylindrical pivot assemblies 200 and 400.

With the arrangement described above, when the infant is napping or crying, connecting tube sections 26*c*, 28*c* are rotated to the position shown in FIG. 2, and adjustment rod 346 is moved down to its lowest position as shown in FIG. 2. In this position, the infant is in a horizontal sleeping position and can be safely rocked back and forth in a transverse direction, that is, between the left and right sides.

When it is desired to feed the infant, connecting tube sections 26*c*, 28*c* are rotated to the position shown in FIG. 8. In this position, stop extensions 50 are supporting adjustable incline sleeper 10 so as to prevent rocking thereof. At the same time, adjustment rod 614 is moved to an upper position such that left side cylindrical pivot assembly 400 is moved away from left side cylindrical pivot assembly 200, whereby the infant is in a partially inclined position, which facilitates feeding of the infant.

Figure 31:
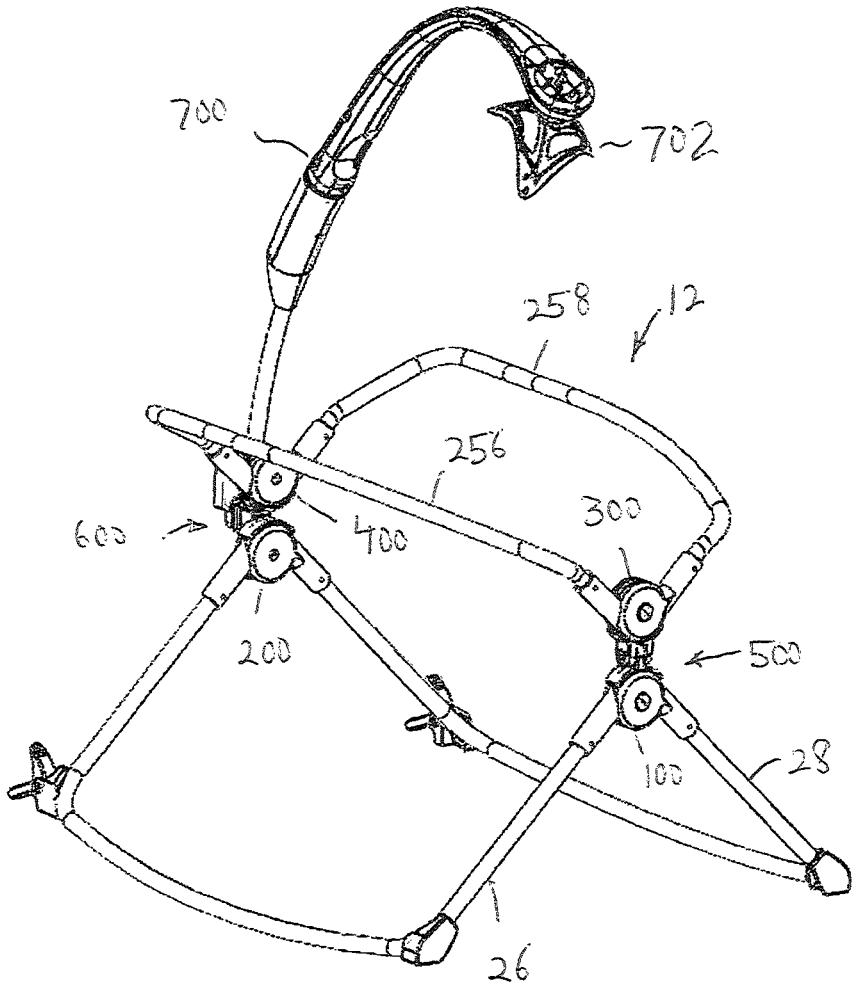
FIG. 31 is a right side perspective view of the frame of the adjustable incline sleeper in a fully opened, rockable configuration and at the lowest inclination angle, and with a curved arm and mobile.

It will be appreciated that various modifications can be made to the invention within the scope of the present claims. For example, a curved arm 700 having a mobile 702 at the upper free end thereof can be mounted to adjustable incline sleeper 10. One manner of mounting curved arm 700 is shown in FIG. 1 by providing a gap in flexible body covering attached to connecting tube section 256*c*, whereby the lower end of curved arm 700 can be clamped onto connecting tube section 256*c*. Another manner of mounting curved arm 700 is shown in FIG. 31 in which the lower end of curved arm 700 telescopically receives the upper end of adjustment rod 614.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. An adjustable incline sleeper comprising:

a lower base frame;

an upper support frame;

a covering body secured to the upper support frame for supporting an infant thereon; and a pivotable connection arrangement for connecting the upper support frame to the lower base frame in a manner to permit transverse pivotable movement of the upper support frame relative to the lower base frame to change an inclination angle between the upper support frame and the lower support frame, wherein the pivotable connection arrangement includes:

a pivot connection which pivotally connects together a first side of the upper support frame to the lower base frame; and an adjustment arrangement for adjusting a vertical separation distance of an opposite second side of the upper support frame to the lower base frame.

2. An adjustment incline sleeper according to claim 1, wherein said adjustment arrangement includes:

a housing mounted to the second side of one of:

the upper support frame and the lower base frame;

an adjustment rod having one end mounted to the second side of the other of:

the upper support frame and the lower base frame;

the adjustment rod slidably received in the housing; and a releasable locking arrangement for releasably locking the adjustment rod at different positions to the housing so as to adjust the distance of the second side of the upper support frame to the lower base frame.

3. An adjustable incline sleeper according to claim 2, wherein the releasable locking arrangement includes a plurality of spaced apart openings in the adjustment rod, and a pin in the housing which is adapted to selectively enter a selected one of the spaced apart openings.

4. An adjustable incline sleeper according to claim 3 wherein the releasable locking arrangement includes:

a slide having the pin secured thereto and which is slidably mounted in a first direction in the housing, the slide including a first wedge surface, a spring member for biasing the slide in a direction for moving the pin into a selected one of the spaced apart openings, and a release member slidably mounted in the housing in a second direction transverse to the first direction, and including a second wedge surface for engaging the first wedge surface to move the slide in a direction against the biasing force of the spring member in order to remove the pin from the selected one of the spaced apart openings.

5. An adjustable incline sleeper comprising:

a lower base frame including lower support members movable between a first rocking position which permits rocking of the adjustable incline sleeper in a transverse direction and a second non-rocking position which prevents rocking of the adjustable incline sleeper;

an upper support frame;

a covering body secured to the upper support frame for supporting an infant thereon; and a pivotable connection arrangement for connecting the upper support frame to the lower base frame in a manner to permit transverse pivotable movement of the upper support frame relative to the lower base frame to change an inclination angle between the upper support frame and the lower support frame, wherein the pivotable connection arrangement includes:

a pivot connection which pivotally connects together a first side of the upper support frame to the lower base frame; and an adjustment arrangement for adjusting a vertical separation distance of an opposite second side of the upper support frame to the lower base frame.

6. An adjustment incline sleeper according to claim 5, wherein said adjustment arrangement includes:

a housing mounted to the second side of one of:

the upper support frame and the lower base frame;

an adjustment rod having one end mounted to the second side of the other of:

the upper support frame and the lower base frame;

the adjustment rod slidably received in the housing; and a releasable locking arrangement for releasably locking the adjustment rod at different positions to the housing so as to adjust the distance of the second side of the upper support frame to the lower base frame.

7. An adjustable incline sleeper according to claim 6, wherein the releasable locking arrangement includes a plurality of spaced apart openings in the adjustment rod, and a pin in the housing which is adapted to selectively enter a selected one of the spaced apart openings.

8. An adjustable incline sleeper according to claim 7, wherein the releasable locking arrangement includes:

a slide having the pin secured thereto and which is slidably mounted in a first direction in the housing, the slide including a first wedge surface, a spring member for biasing the slide in a direction for moving the pin into a selected one of the spaced apart openings, and a release member slidably mounted in the housing in a second direction transverse to the first direction, and including a second wedge surface for engaging the first wedge surface to move the slide in a direction against the biasing force of the spring member in order to remove the pin from the selected one of the spaced apart openings.

9. An adjustable incline sleeper according to claim 5, wherein:

the lower base frame includes:

a first U-shaped base tube including one lower support member;

a second opposite U-shaped base tube including another lower support member; and a first pivoting connection assembly which pivotally connects together the first and second U-shaped base tubes for movement between an inverted V-shape in an operative condition of the adjustable incline sleeper and a collapsed, closed condition in which the first and second U-shaped base tubes are substantially parallel and adjacent to each other.

10. An adjustable incline sleeper according to claim 9, wherein:

the upper support frame includes:

a third U-shaped support tube having an upper end to which the covering body is secured;

a fourth U-shaped support tube having an upper end to which the covering body is secured; and a second pivoting connection assembly which pivotally connects together the third and fourth U-shaped support tubes for movement between a V-shape in an operative condition of the adjustable incline sleeper and a collapsed, closed condition in which the third and fourth U-shaped support tubes are substantially parallel and adjacent each to other.

11. An adjustable incline sleeper according to claim 10, wherein:

the first pivoting connection assembly includes:

a lower left side pivot assembly which pivotally connects together a left side of the first and second U-shaped support tubes, and a lower right side pivot assembly which pivotally connects together a right side of the first and second U-shaped support tubes, and the second pivoting connection assembly includes:

an upper left side pivot assembly which pivotally connects together a left side of the third and fourth U-shaped support tubes, and an upper right side pivot assembly which pivotally connects together a right side of the third and fourth U-shaped support tubes.

12. An adjustable incline sleeper according to claim 11, wherein:

the pivot connection pivotally connects together the lower right side pivot assembly and the upper right side pivot assembly; and the adjustment arrangement is connected between the lower left side pivot assembly and the upper left side pivot assembly for adjusting a vertical separation distance of a left side of the upper support frame to the lower base frame.

13. An adjustment incline sleeper according to claim 12, wherein said adjustment arrangement includes:

a housing mounted to one of:

the lower left side pivot assembly, and the upper left side pivot assembly;

an adjustment rod having one end mounted to the other of:

the lower left side pivot assembly, and the upper left side pivot assembly;

the adjustment rod slidably received in the housing; and a releasable locking arrangement for releasably locking the adjustment rod at different positions to the housing so as to adjust the distance of the upper left side pivot assembly to the lower left side pivot assembly.

14. An adjustable incline sleeper according to claim 13, wherein the releasable locking arrangement includes a plurality of spaced apart openings in the adjustment rod, and a pin in the housing which is adapted to selectively enter a selected one of the spaced apart openings.

15. An adjustable incline sleeper according to claim 14, wherein the releasable locking arrangement includes:

a slide having the pin secured thereto and which is slidably mounted in a first direction in the housing, the slide including a first wedge surface, a spring member for biasing the slide in a direction for moving the pin into a selected one of the spaced apart openings, and a release member slidably mounted in the housing in a second direction transverse to the first direction, and including a second wedge surface for engaging the first wedge surface to move the slide in a direction against the biasing force of the spring member in order to remove the pin from the selected one of the spaced apart openings.

16. An adjustable incline sleeper comprising:

a lower base frame including lower support members movable between a first rocking position which permits rocking of the adjustable incline sleeper in a transverse direction and a second non-rocking position which prevents rocking of the adjustable incline sleeper;

an upper support frame;

a covering body secured to the upper support frame for supporting an infant thereon; and a pivotable connection arrangement for connecting the upper support frame to the lower base frame in a manner to permit transverse pivotable movement of the upper support frame relative to the lower base frame to change an inclination angle between the upper support frame and the lower support frame, wherein each said lower support member includes a curved tube which is movable between a downwardly convex position in the first rocking position and an upwardly convex position in the second non-rocking position.

17. An adjustable incline sleeper according to claim 16, wherein the curved tube further includes at least one stop extension mounted thereto which is moved into supporting contact with a ground surface to prevent rocking of the adjustable incline sleeper when the curved tube is moved to the upwardly convex position in the second non-rocking position.

18. An adjustable incline sleeper according to claim 16, further including an arrangement for releasably locking the curved tube between the downwardly convex position in the first rocking position and the upwardly convex position in the second non-rocking position.

* * * * *